US005478161A

United States Patent [19]

Suzuki et al.

[11] Patent Number: 5,478,161

[45] Date of Patent: Dec. 26, 1995

[54] PAPER DISCHARGE APPARATUS HAVING A FEED CONTROLLER

[75] Inventors: Kanji Suzuki; Tadashi Nonaka, both of Shizuoka, Japan

[73] Assignee: Star Micronics Co., Ltd., Shizuoka, Japan

[21] Appl. No.: 298,330

[22] Filed: Aug. 30, 1994

[30] Foreign Application Priority Data

Sep. 8, 1993 [JP] Japan ..... 5-248835

[51] Int. Cl.[6] ..... B41J 11/42

[52] U.S. Cl. ..... 400/582; 400/593; 400/621

[58] Field of Search ..... 400/582, 592, 400/593, 596, 603, 621, 636, 161, 708, 279; 355/311; 395/111; 226/15, 24, 88

[56] References Cited

U.S. PATENT DOCUMENTS

| | | | |
|---|---|---|---|
| 4,449,835 | 5/1984 | Arai | 400/161 |
| 4,639,739 | 1/1987 | Tsutsumi | 400/621 |
| 4,663,638 | 5/1987 | Hirose | 400/621 |
| 4,679,953 | 7/1987 | Sone et al. | 400/708 |
| 4,878,428 | 11/1989 | Watarai | 400/708 |
| 5,041,845 | 8/1991 | Ohkubo et al. | 400/621 |
| 5,133,615 | 7/1992 | Saito et al. | 400/621 |
| 5,215,393 | 6/1993 | Wincent . | |
| 5,241,331 | 8/1995 | Chiku | 400/636 |
| 5,328,281 | 7/1994 | Narita | 400/708 |

FOREIGN PATENT DOCUMENTS 1-181659 7/1989 Japan .

*Primary Examiner*—Edgar S. Burr
*Assistant Examiner*—John S. Hilten
*Attorney, Agent, or Firm*—Pollock, Vande Sande & Priddy

[57] ABSTRACT

The present invention relates to a paper discharge apparatus provided together with a printer for discharging printed matter such as a receipt or a ticket. The paper discharge apparatus stores paper then feeds it during printing, and discharges the paper upon completion of printing. It is possible to perform stable printing and discharge operations because a recipient does not touch the paper during printing. The paper discharge apparatus stops the discharge of the paper when an obstruction occurs, and it quickly restarts the discharge when the obstruction is removed.

4 Claims, 22 Drawing Sheets

PAPER DISCHARGE APPARATUS HAVING A FEED CONTROLLER

BACKGROUND OF THE INVENTION

1. Field of the Invention

The present invention relates to a paper discharge apparatus attached to a printer for use in discharging a continuous recorded paper such as a printed receipt, ticket, etc.

2. Description of the Prior Art

In a conventional printer adapted for use in an issuing apparatus for issuing a receipt, ticket, etc., a continuous paper is printed and discharged, then cut off upon completion of printing.

FIG. 21A shows an outer appearance of the conventional printer. A paper discharge port 306 is provided at a front surface panel portion 304 of an outer casing 302. A continuous paper 308 is discharged from the paper discharge port 306 depending on the printing operation while it is printed. A recipient can receive the discharged paper 308 while picking up it with fingers.

FIG. 21B shows an internal structure of the conventional printer. There is formed a paper feed passage 310 which extends from the inside of the outer casing 302 to the paper discharge port 306. A paper feed mechanism 312, a print mechanism 314 and a cutter mechanism 316 are respectively provided on the paper feed passage 310. The paper feed mechanism 312 is a means for feeding the paper 308 in synchronization with printing. The paper feed mechanism 312 is provided with a pair of driving rollers 318 and 320. The paper 308 is guided between and clamped by the driving rollers 318 and 320 and fed out by the rotation of the driving rollers 318 and 320 while it is pressed by and brought into contact with the driving rollers 318 and 320. The print mechanism 314 comprises a print head 322 and a platen 324 which are confronted to each other while interposing the paper feed passage 310 therebetween. When the print head 322 is driven, the paper 308 is printed. Printing form is varied depending on the kind of the paper 308. If a heat sensitive paper is used, an ink ribbon is not needed while if an ordinary paper is used, a color medium such as the ink ribbon is needed. A cutter mechanism 316 is composed of an independent unit and contains therein a cutter blade 326 which slides in the direction perpendicular to the feeding direction of the paper 308. The cutter blade 326 is driven by a slide driving mechanism. In the cutter mechanism 316, when the cutter blade 326 slides downward in FIG. 21B, the paper 308 is cut off.

In this printer, the paper 308 is discharged from the port 306 while it is printed. Upon completion of printing, the paper 308 is discharged continuously by a given amount and cut off by the cutter blade 326 when the cutter blade 326 slides.

If such a printer is employed by the issuing apparatus for issuing the receipts or the tickets, it is expected that the recipient stands by for completion of printing while picking up an end of the paper 308 with fingers. It is also expected that the recipient obstructs the discharge of the paper 308. FIG. 22 shows an example of a case where the recipient stands by for an issuance of the paper 308. That is, when the recipient stands by while picking up the paper 308, the paper 308 is prevented from being smoothly fed so that the paper 308 while it is fed on the paper feed passage 310 is liable to generate bending 328. The bending 328 gives unnecessary stress on the paper 308 in the direction opposite to the discharge direction of the paper 308. As a result, the paper

308 is bent inside the printer and a normal discharge operation can not be performed, which causes a paper jam, which eventually leads to malfunction of the apparatus.

FIG. 23A shows a case where the recipient forcibly pulls out the paper 308 to be discharged. If tension T is applied to the paper 308, the tension T applies unnecessary load to an edge of the cutter blade 326 in the direction perpendicular to the sliding direction F. If the load is extremely large, an edge 330 of the cutter blade 326 is damaged as shown in FIG. 23B. If the edge 330 is bent, there occurs a possibility that the cutter blade 326 can not slide or the cutting operation is deteriorated.

In such a conventional printer, there is provided a means to prevent the recipient from touching the paper 308 until printing on the paper 308 having a predetermined length has been finished and the printed paper 308 has been discharged. For example, such a printer is disclosed in Japanese Utility Model Laid-Open Publication No. 5-29765. In this printer, a cover having a depth corresponding to the length of the paper 308 to be issued is attached to a paper discharge portion and the paper 308 is guided within the cover to prevent the recipient from touching the paper 308 and the paper 308 can be discharged from the cover only when the paper 308 is cut off.

However, such a printer has the following problems. Since the cover protrudes from the printer, the cover per se is liable to be damaged. Furthermore, since the size of the cover corresponds to the length of the paper 308, if the length of the paper 308 to be issued is changed, it must be changed to correspond to the changed length of the paper 308, which makes the issuing apparatus large.

There has been proposed paper discharge apparatuses as a means for coping with the aforementioned problems as disclosed in Japanese Patent Laid-Open Publication No. 1-181659 and U.S. Pat. No. 5,125,393. In such apparatuses, the paper is slackened and on standby in the discharge passage until a printing operation is completed, thereby preventing the recipient from receiving the paper but the paper is cut off and discharged from a discharge port upon completion of the printing operation.

However, in case that the recipient blocks the paper discharge port of these paper discharge apparatuses intentionally by fingers, Japanese Patent Laid-Open Publication No. 1-181659 does not disclose any means to cope therewith, which causes a problem of paper jam. In U.S. Pat. No. 5,125,393, if the paper discharge is blocked, the paper which has been on standby within the cover is guided downward by rollers. In this case, namely, if the paper is discharged through another route instead of the discharge port, the recipient can not receive the paper, which causes another problem.

Furthermore, in such a paper discharge apparatus, since a passage extending from the print mechanism to the discharge port is made long and the rollers are used for discharging the paper, conditions of the paper influences upon the feeding of the paper by the rollers. There is a possibility that such an apparatus is installed indoor and outdoor and is used under high temperature and high humidity. Although a standardized paper is used as the paper, there occur such problems that the standardized paper is softened under high temperature and high humidity and the paper is liable to be deformed at the portion where it is held between the contacted rollers due to pressure by the contacted surfaces of the rollers. The softened paper generates excessive friction between the rollers or it is adhered to the surfaces of the rollers, so that the paper is difficult to be fed.

If wrinkles are generated on the paper between the surfaces of rollers due to the pressure by the rollers, the paper is liable to be bent at the wrinkled portions, so that the paper is difficult to be clamped by the rollers. In case of a rolled paper, it is liable to be curled or wrinkled, which prevents the paper from being fed between the rollers. This causes the paper jam. Japanese Patent Laid-Open Publication No. 1-181659 employs a driving lever for assisting the paper to inroad between the rollers. However, a mechanism of this driving mechanism is complicated and it rather causes the paper jam.

SUMMARY OF THE INVENTION

It is therefore an object of the invention to provide a paper discharge apparatus capable of solving such a problem caused by conditions of a paper and capable of discharging the paper stably when the discharge of the paper is obstructed at a discharge portion of the apparatus.

To achieve the object, the paper discharge apparatus provided together with a printer for discharging a printed paper according to the present invention comprises a paper feed means for feeding a paper to be printed or under printing, and discharge rollers for clamping and holding a leading end of the paper which is fed by the paper feed means 8. The discharge rollers discharge the paper upon completion of printing, a paper storage means for storing the paper is in a slackened condition with the leading end thereof held by the discharge rollers, a paper discharge passage for guiding the paper which was discharged by the discharge rollers to a paper discharge port. Also, there is a paper detection sensor for detecting the leading end of the paper which passes thereunder along the paper discharge passage, a control means for stopping rotation of a motor for driving the discharge rollers and at the same time operating the paper feed means so as to feed the paper toward the paper storage means in a slackened condition when the paper detection sensor detects the paper which arrives thereunder. The control means drive the motor upon completion of printing to thereby discharge the paper, and the control means also stops the operation of the motor when the paper detection sensor detects a discharge of the paper, and a discharge buffer means attached to a driving shaft of the discharge rollers for transmitting driving force of the motor to the driving shaft, the buffer means buffering the discharge of the paper by running idle so as not to transmit the driving force of the motor to the driving shaft when the discharge of the paper is obstructed.

With such an arrangement of the paper discharge apparatus, the paper is held at the leading end by the discharge rollers during printing and it is bent and curled at its middle portion to be stored in the paper storage portion. Upon completion of printing and cutting, the discharge rollers are driven to discharge the paper from the discharge port. If the paper discharge is obstructed, the driving force to be transmitted to the discharge roller is shut off so that the discharge of the paper is buffered. Accordingly, it is possible to prevent a paper jam which is liable to occur when the paper is forcibly discharged. When the obstruction is removed, the driving force is recovered, so that the paper is smoothly discharged and the recipient can receive the paper.

An opening angle defined between the two discharge rollers relative to the paper to be discharged can be widened so as to easily hold the paper which is softened or bent, whereby the paper jam can be prevented before it is discharged.

Other object and features of the present invention can be apparent from the following description taken into account the attached drawings.

PREFERRED EMBODIMENT OF THE INVENTION

Figure 1:
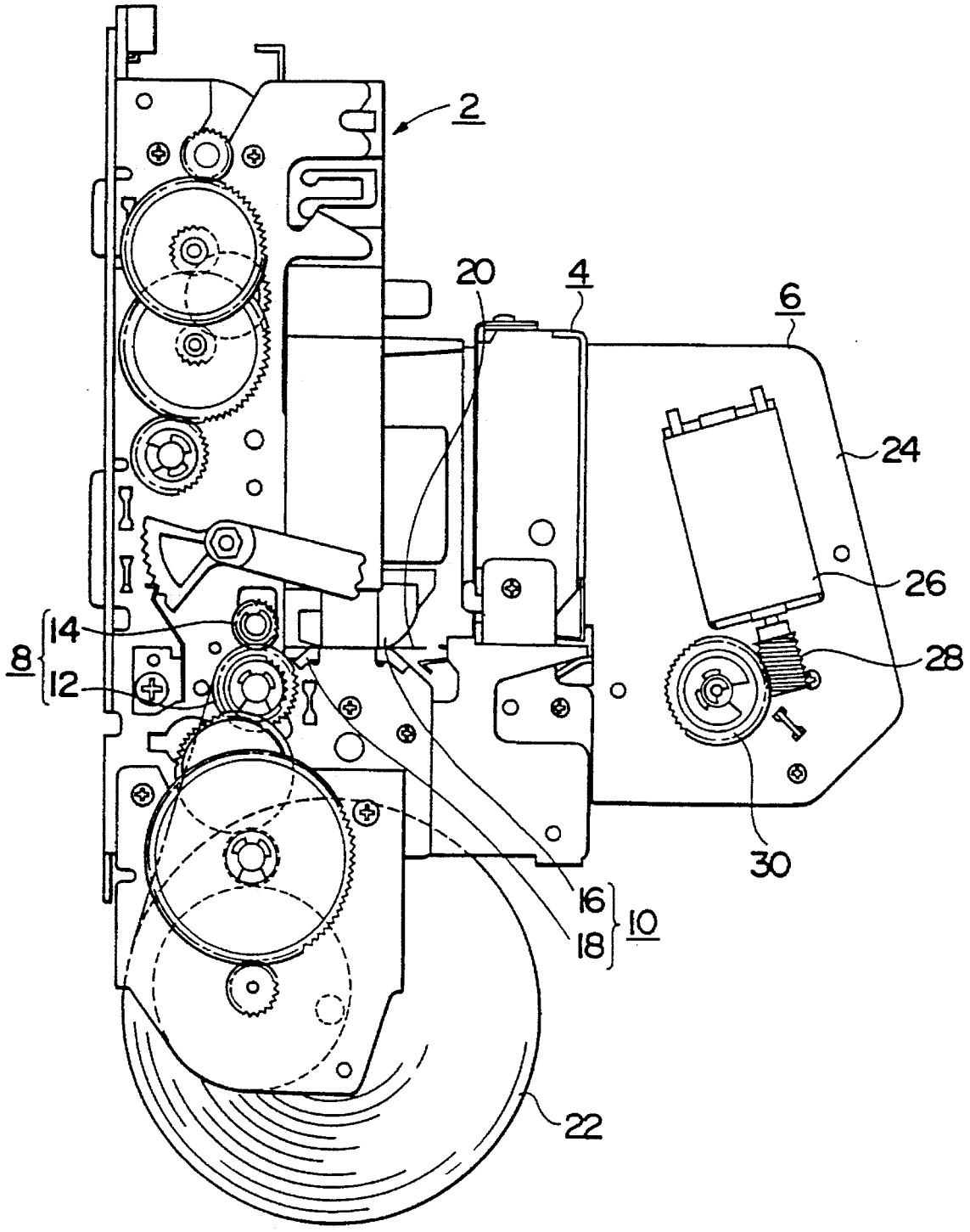
FIG. 1 is a side view of an issuing apparatus having a paper discharge apparatus according to a first embodiment of the present invention.

First Embodiment (FIGS. 1 to 16):

FIG. 1 shows an issuing apparatus for issuing receipts, tickets, etc. which employs a paper discharge apparatus according to a first embodiment of the invention.

Elements in the first to fourth embodiments and the modification of the present invention are denoted at the same numerals.

The issuing apparatus comprises a printer 2, a cutting apparatus 4 and a paper discharge apparatus 6. The printer 2 is provided with a paper feed mechanism 8 for feeding a paper to be printed 20 and a print mechanism 10. The paper feed mechanism 8 is provided with feed rollers 12 and 14 which rotate when receiving torque from a motor, not shown. The print mechanism 10 is provided with a print head 16 and a platen 18. A roll paper 22 from which the paper 20 is supplied is mounted on the printer 2. The cutting apparatus 4 cuts off the paper 20 upon completion of printing.

The paper discharge apparatus 6 is a means for discharging the paper 20 which is transported from the cutting apparatus 4 and a motor 26 as a driving means is mounted on one of side plates 24. Torque of the motor 26 is transmitted to a torque limiter 30 by way of a worm gear 28 attached to a rotary shaft of the motor 26.

Figure 2:
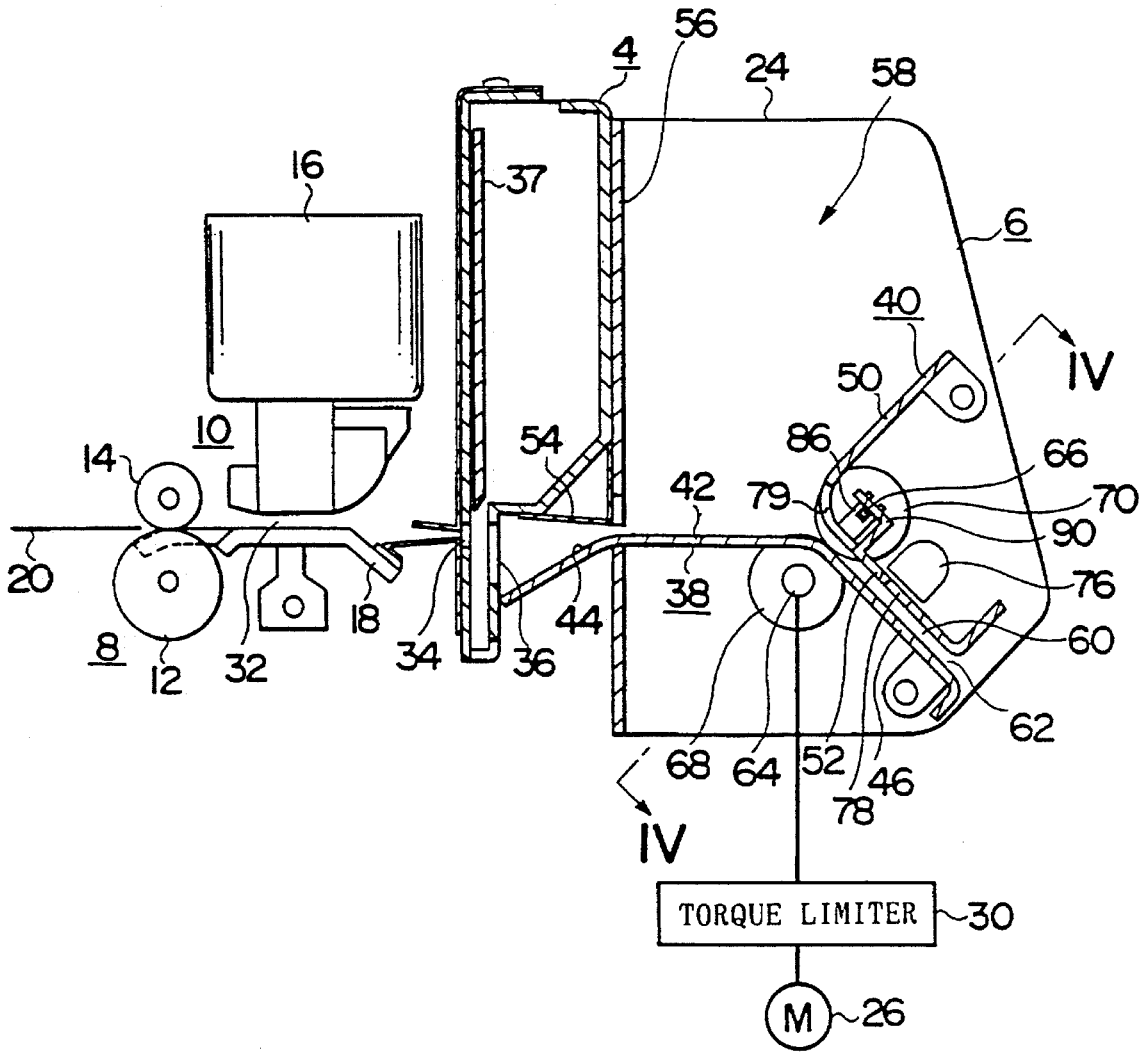
FIG. 2 is a cross-sectional view of the paper discharge apparatus in FIG. 1.

FIG. 2 shows a concrete arrangement of the printer 2, the cutting apparatus 4 and the paper discharge apparatus 6. The paper 20 is fed along a paper feed passage 32. That is, the paper 20 is fed by the feed rollers 12 and 14 of the paper feed mechanism 8 and is guided between the print head 16 and the platen 18 of the print mechanism 10. A printing operation against the paper 20, namely, the paper 20 is printed in synchronization with a paper feeding operation by the feed rollers 12 and 14.

The paper 20 is fed toward the paper discharge apparatus 6 by way of the cutting apparatus 4 as printing goes. There are formed in the cutting apparatus 4 through holes 34 and 36 through which the paper 20 passes. The cutting apparatus 4 is provided with a cutter blade 37. The cutter blade 37 slides in a direction perpendicular to the paper 20 under transportation and cuts off the paper 20 upon reception of driving force from a motor, not shown, in synchronization with completion of printing. The cutter blade 37 returns to its original position as shown in FIG. 2 after the cutting operation.

Figure 3:
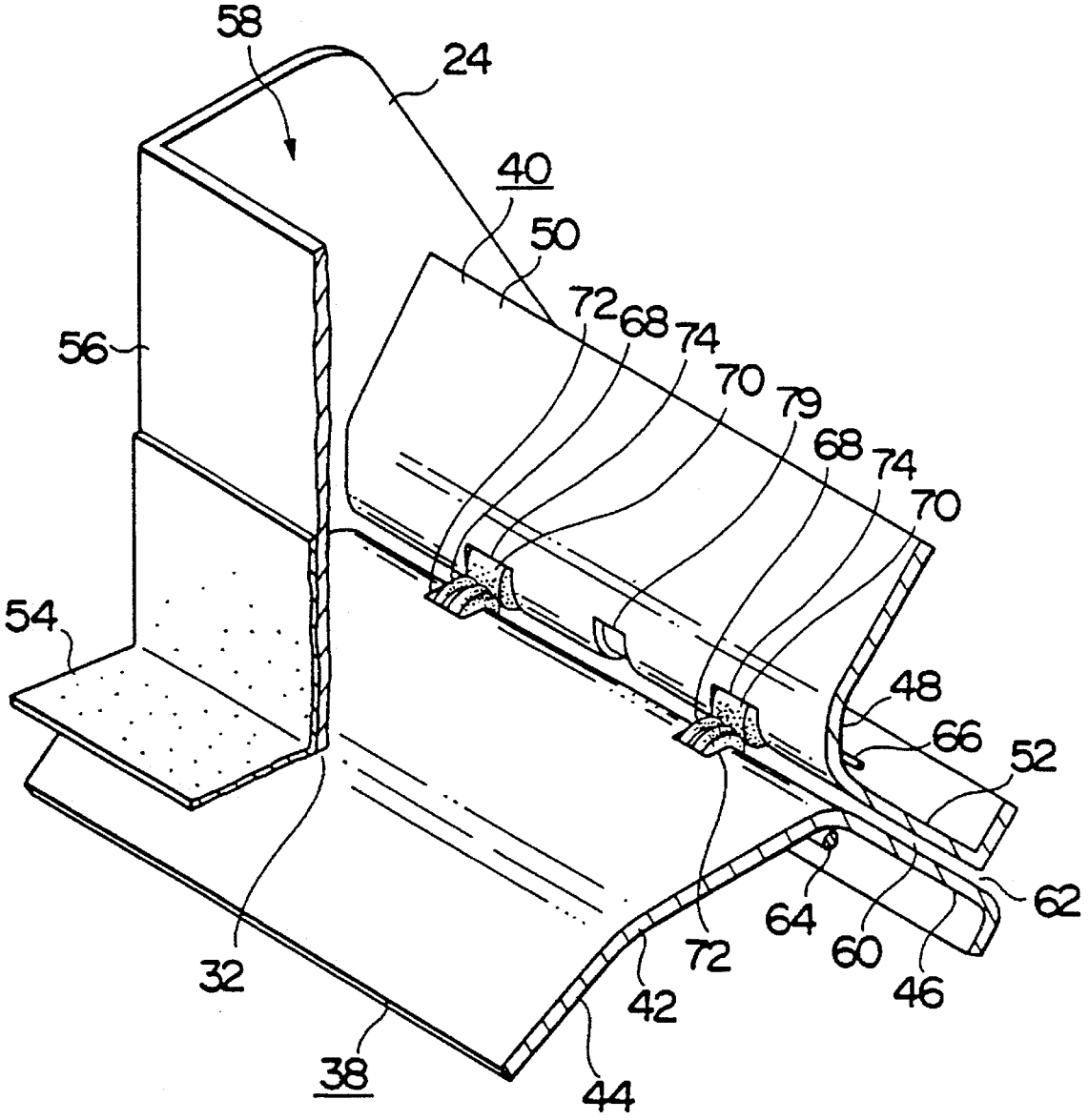
FIG. 3 is a partly broken perspective view of a paper storage portion and discharge rollers of the paper discharge apparatus in FIG. 2.

There are provided in the paper discharge apparatus 6 first and second guide plates 38 and 40 as means for guiding the paper 20. The first guide plate 38 has a horizontal portion 42 at its middle part and inclined portions 44 and 46 at its front and rear parts thereof. The other guide plate 40 has a curved portion 48 at its middle part as shown in FIG. 3 and inclined portions 50 and 52 about the curved portion 48, namely, at its front and rear parts thereof.

The inclined portion 44 of the first guide plate functions as an introduction means for introducing the paper 20 to be fed into the horizontal portion 42. For enhancing the function as the introduction means, a guide piece 54 as an auxiliary guide means is attached to an upright wall 56 of the paper discharge apparatus 6 above the inclined portion 44. The guide piece 54 functions as a bridge of the paper feed passage 32 between the cutting apparatus 4 and the paper discharge apparatus 6.

There is formed a space which is surrounded by the horizontal portion 42 of the guide plate 38, the inclined portion 50 of the guide plate 40, the side plates 24 and the upright wall 56. This space constitutes a paper storage means 58 for curling the paper 20 during printing and temporarily storing the paper 20 therein. The inclined portion 46 of the guide plate 38 is disposed in parallel with the inclined portion 52 of the guide plate 40 and a space defined between the inclined portions 46 and 52 forms a paper discharge passage 60. The paper discharge passage 60 extends and inclines from the horizontally provided paper feed passage 32 and descends toward a paper discharge port 62 provided at an end portion of the paper discharge passage 60.

There is provided a driving shaft 64 for receiving the torque from the motor 26 by way of the torque limiter 30 at a rear side of the guide plate 38. There is provided a supporting shaft 66 at the rear side of the guide plate 40. The driving shaft 64 is confronted with the supporting shaft 66 while interposing the paper discharge passage 60 therebetween. The supporting shaft 66 is displaced toward the paper discharge port 62 relative to the driving shaft 64. The supporting shaft 66 is supported by bearing portions 86 and an L-shape retaining portion 90 respectively formed on the guide plate 40. An opening 79 is formed on the guide plate 40 to provide the retaining portion 90 by punching and press machining the guide plate 40.

A pair of discharge rollers 68 are attached to the driving shaft 64 and another pair of discharge rollers 70 which contact the discharge rollers 68 are rotatably supported by the supporting shaft 66. Windows 72 are provided on the guide plate 38 for protruding the discharge rollers 68 and another windows 74 are provided on the guide plate 40 for protruding the discharge rollers 70. That is, roller surfaces of the discharge rollers 68 and 70, which protrude through the windows 72 and 74 are brought into contact with each other. The motor 26 is connected to the driving shaft 64 by way of the torque limiter 30 as a discharge buffer means for buffering the discharge of the paper 20. That is, the torque of the motor 26 is transmitted from the driving shaft 64 to the discharge rollers 68 by way of the torque limiter 30. Accordingly, the paper 20 is clamped by the discharge rollers 68 and 70 and is fed toward the paper discharge passage 60 while it is pressed thereby.

A paper detection sensor 76 is provided on the paper discharge passage 60 as a means for detecting arrival of a leading end of the paper 20. The paper detection sensor 76 is disposed at the rear side of the guide plate 40 and the detecting surface thereof directs through a window 78 of the guide plate 40 toward the paper discharge passage 60. The paper detection sensor 76 is, for example, an optical detecting means comprising a light emitter and a light receiver. The light emitter throws light upon the paper discharge passage 60 and the light receiver receives reflected light from the paper 20, whereby the paper detection sensor 76 detects the presence of the paper 20.

Figure 4:
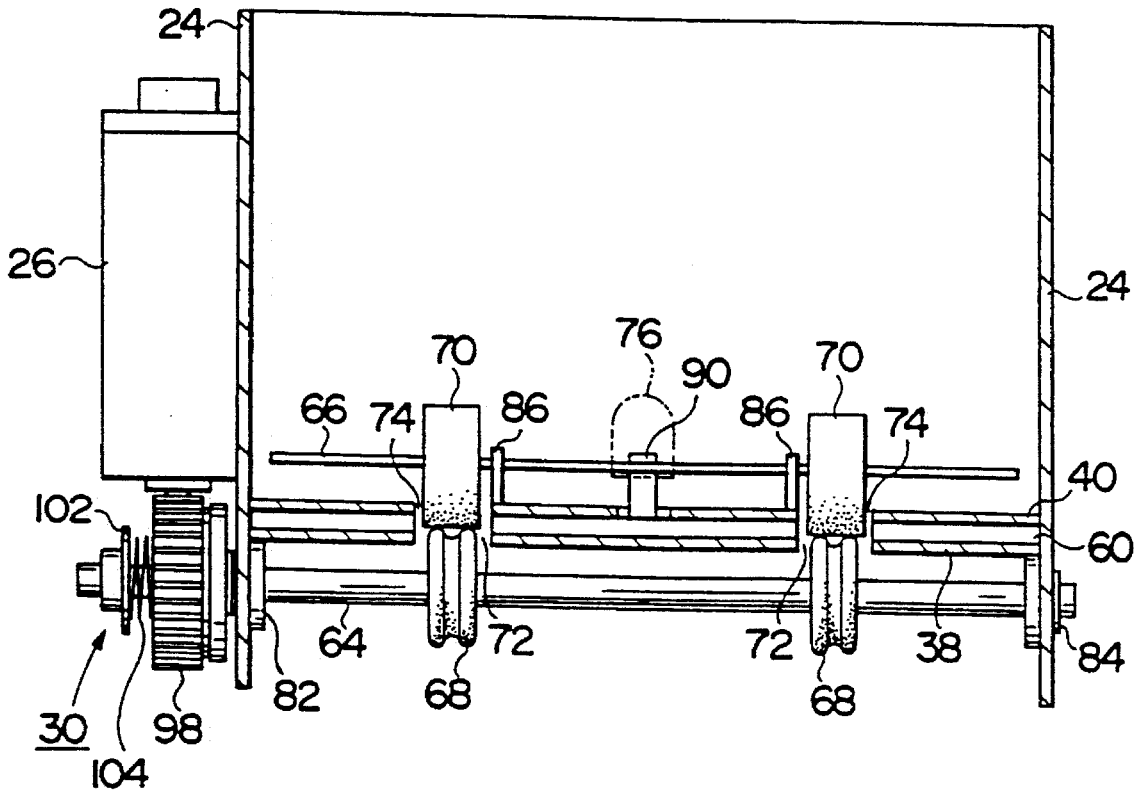
FIG. 4 is a cross-sectional view of the paper discharge apparatus taken along IV—IV in FIG. 2.

FIG. 4 is a cross-sectional view of the paper discharge apparatus 6 taken along IV—IV in FIG. 2 showing a driving system of the discharge rollers 68 and 70. The worm gear 28 is attached to the rotary shaft of the motor 26 mounted on one of the side plates 24. After the driving force of the worm gear 28 is transmitted to the torque limiter 30, it is transmitted to the driving shaft 64 by way of the torque limiter 30. The driving shaft 64 is supported by bearings 82 and 84 attached to the side plates 24.

Figure 5:
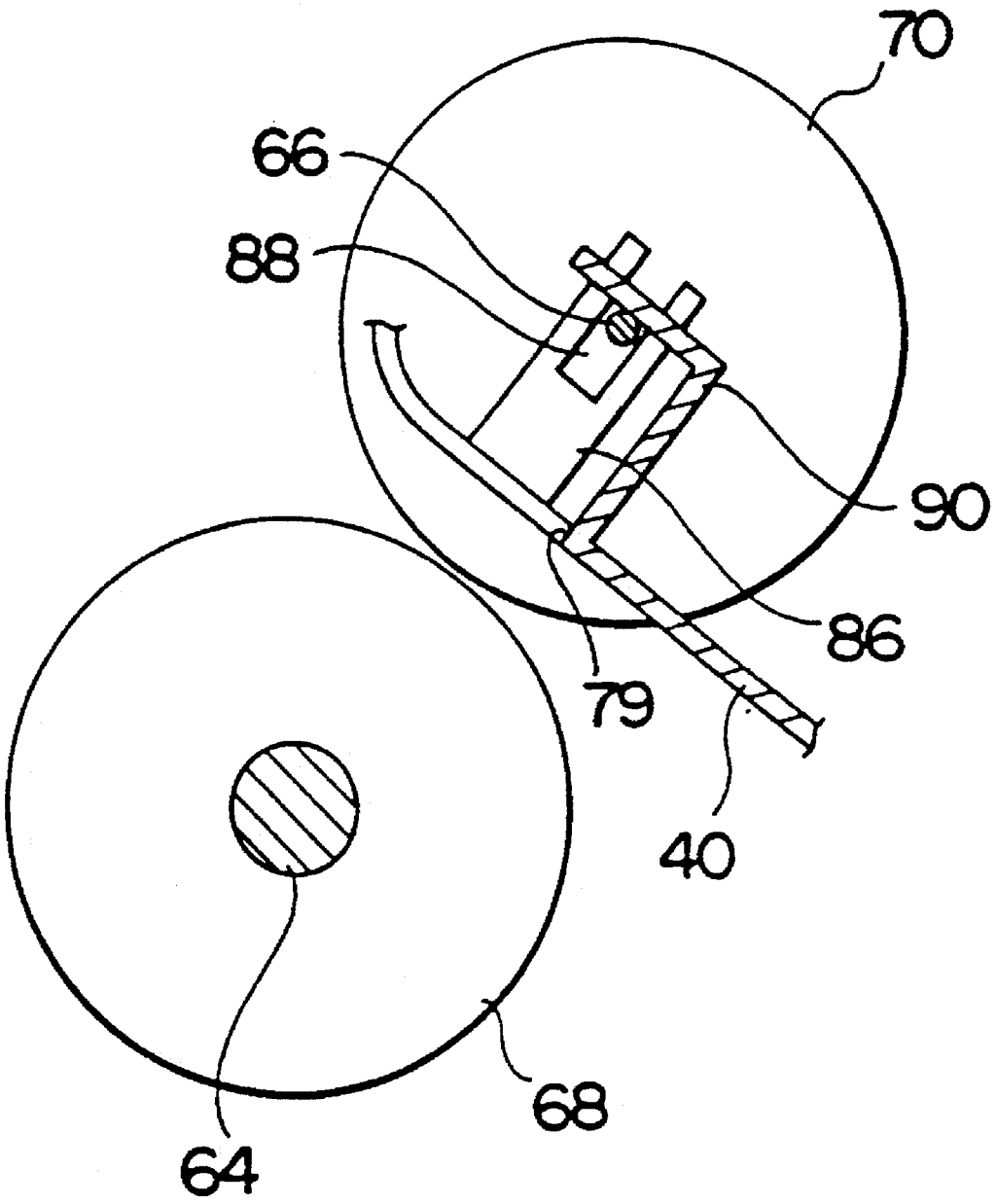
FIG. 5 is a view showing an elastic supporting structure of the discharge rollers.

FIG. 5 shows a supporting mechanism of the discharge rollers 70 which are driven by the discharge rollers 68. The discharge rollers 68 and 70 are required to be brought into contact with each other under appropriate pressure so as to feed the paper 20 therethrough. Accordingly, an elastic metal shaft is employed by the supporting shaft 66 for supporting the discharge rollers 70. The supporting shaft 66 is movably inserted into grooves 88 of the bearings 86 formed on the guide plate 40 and it is restrained by the retaining portion 90 so that it does not come off from the grooves 88. As a result, the discharge rollers 68 are brought into contact with the discharge rollers 70 under pressure and the discharge rollers 70 can be movable depending on the paper 20 within the allowable movable extent of the supporting shaft 66 in the grooves 88.

Figure 6:
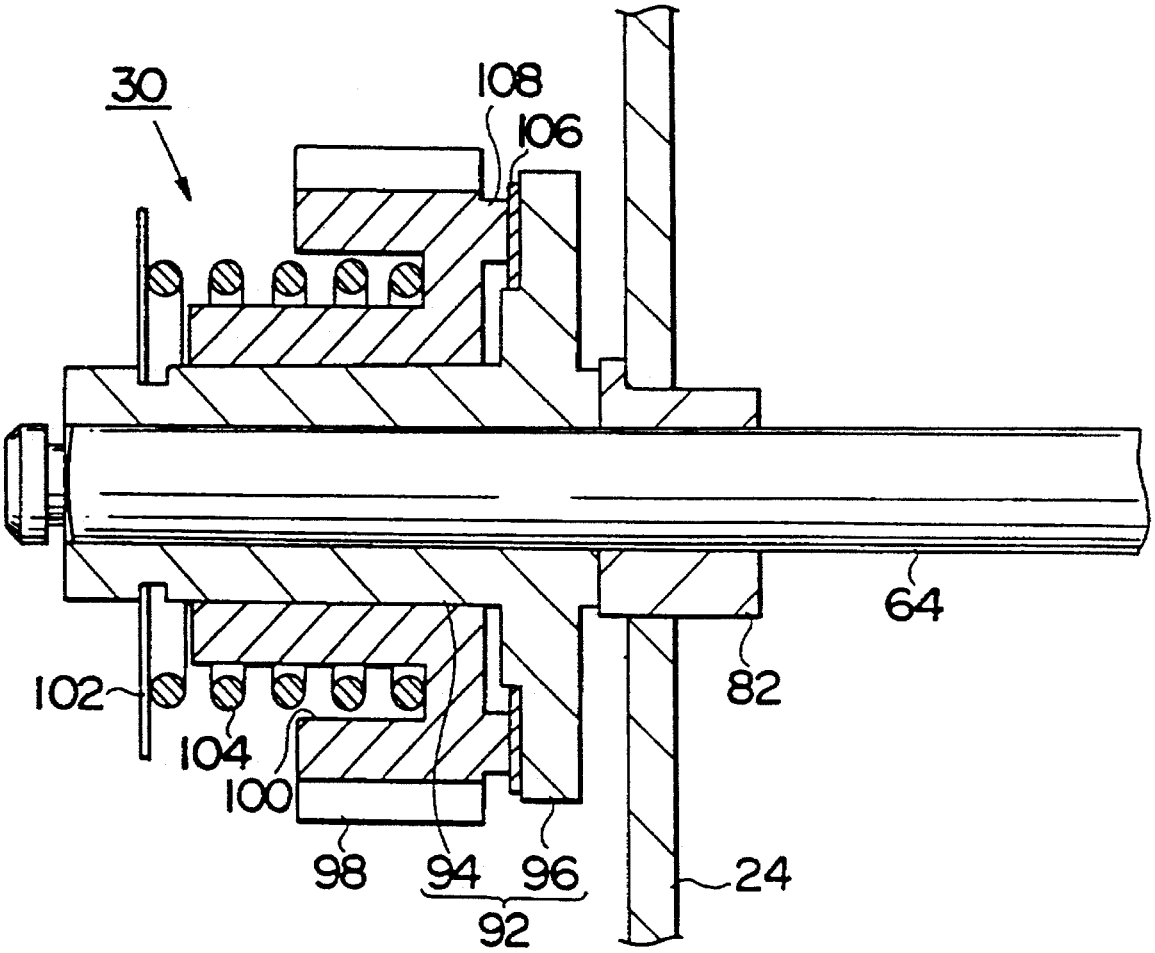
FIG. 6 is a longitudinal cross-sectional view of a torque limiter.

FIG. 6 shows a concrete arrangement of the torque limiter 30. The driving shaft 64 of the discharge rollers 68 is supported by the side plates 24 by way of the bearings 82 and protrudes outside from the side plates 24. A clutch portion 92 is fixed to the driving shaft 64 and comprises a small diameter portion 94 and a flange portion 96 wherein a gear 98 is rotatably provided on the small diameter portion 94. The gear 98 has a recessed portion 100 in its axial direction. A coil spring 104 is inserted between the recessed portion 100 and a disk-shaped spring receiver 102 which is fixed to the small diameter portion 94 of the clutch portion 92 for biasing the gear 98 to a wall surface of the flange portion 96. A slip member 106 is attached to the flange portion 96 of the clutch portion 92 and a ring-shaped contact portion 108 which is formed on the gear 98 is brought into contact with the slip member 106 by pressure of the coil spring 104.

According to the torque limiter 30 having the structure as set forth above, the torque of the motor 26 is transmitted from the worm gear 28 to the gear 98. The clutch portion 92 is normally frictionally engaged with the gear 98 by the pressure of the coil spring 104 so that the driving force of the gear 98 is transmitted to the driving shaft 64.

Whereupon, when a force is applied to the driving shaft 64 by way of the discharge rollers 68 which prevents rotation of the driving shaft 64, if such a force exceeds pressure by the coil spring 104 and friction generated between the clutch portion 92 and the contact portion 108 of the gear 98, the gear 98 runs idle and the torque transmission is prevented. As a result, the paper 20 is prevented from being discharged by the discharge rollers 68 and 70. That is, when the discharge of the paper 20 is obstructed, stress generated by the obstruction and applied to the paper 20 is transmitted to the driving shaft 64 so that the gear 98 idles.

Figure 7:
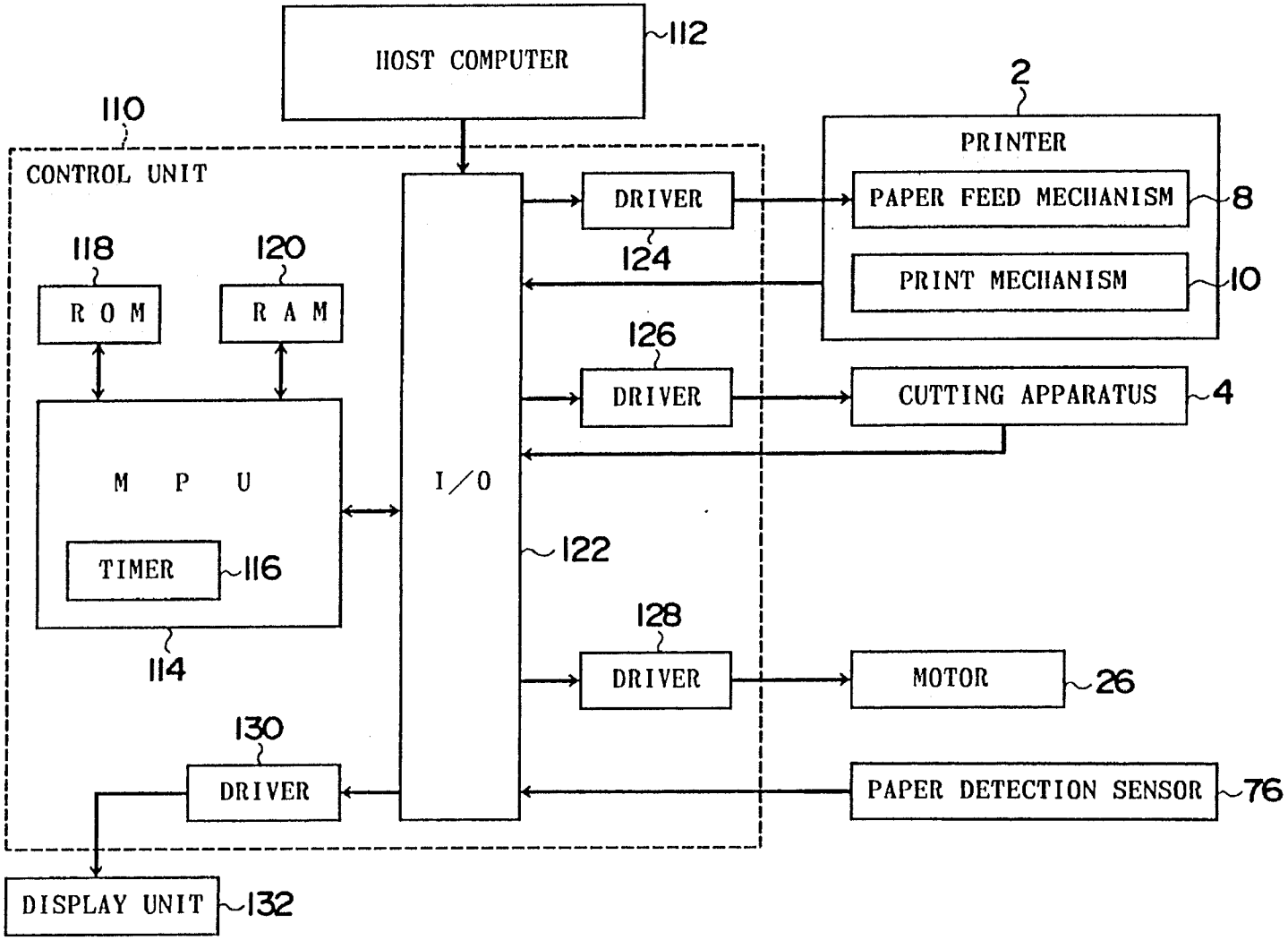
FIG. 7 is a block diagram of a control unit of the paper discharge apparatus.

FIG. 7 shows an arrangement of a control means of the issuing apparatus. The control means includes a control unit 110 for controlling the paper feeding operation, the paper printing operation, the paper cutting operation and the paper discharging operation. According to a preferred embodiment, the paper printing operation and the paper discharging operation are controlled by the single control unit 110 but they may be controlled individually.

The control unit 110 comprises, e.g., a microcomputer for communicating with a host computer 112 and executing various controls. A microprocessor unit (MPU) 114 as a central processing unit controls various operations such as the paper feeding operation, the paper printing operation, the paper cutting operation and the paper discharging operation and also performs arithmetic operations in accordance with a program. The MPU 114 includes a timer 116 as a means for setting and controlling time.

The control unit 110 includes a ROM 118 and a RAM 120 as a main memory means for storing therein a control program to be executed by the MPU 114, a control data and data under processing, etc. The ROM 118 is a read only memory having a control program, a table, etc., and the RAM 120 is a random access memory for storing data under processing, etc. It is possible to employ a memory medium such as a flexible diskette, etc. as an auxiliary storing means, not shown, instead of the RAM 120. A storing means attached to the host computer 112 can also be used as the auxiliary storing means of the control unit 110.

The control unit 110 also includes an input/output unit (I/O) 122 for receiving input data from the host computer 112 or supplying a control output. The I/O 122 is connected to the MPU 114, the ROM 118 and the RAM 120 by way of a bus. The I/O 122 is connected to a switch and the like through which an on-line operation instruction from the host computer 112 is input to the I/O 122 but such switch and the like are omitted since they are not directly related to the paper discharge apparatus 6 of the invention.

The I/O 122 is connected to first, second, third and fourth drivers 124, 126, 128 and 130. The first driver 124 is a driving output means for supplying a driving output necessary for printing to the printer 2, and the second driver 126 is a driving output means for supplying a driving output necessary for cutting to the cutting apparatus 4 while the third driver 128 is a driving output means for supplying a driving output necessary for discharging the paper 20 to the motor 26, and the fourth driver 130 is a driving output means for supplying a driving output necessary for indicating error to an indicator 132.

The printer 2 is provided with the paper feed mechanism 8 and the print mechanism 10. The paper feed mechanism 8 is a means for feeding the paper 20 toward the print mechanism 10 and comprises feed rollers driven by the motor rotating in synchronization with printing operation. The print mechanism 10 is a means for printing the paper 20 in response to a print data from the host computer 112.

Described hereinafter is each of the paper feeding operation, the paper printing operation, the paper cutting operation and the paper discharging operation.

Figure 8:
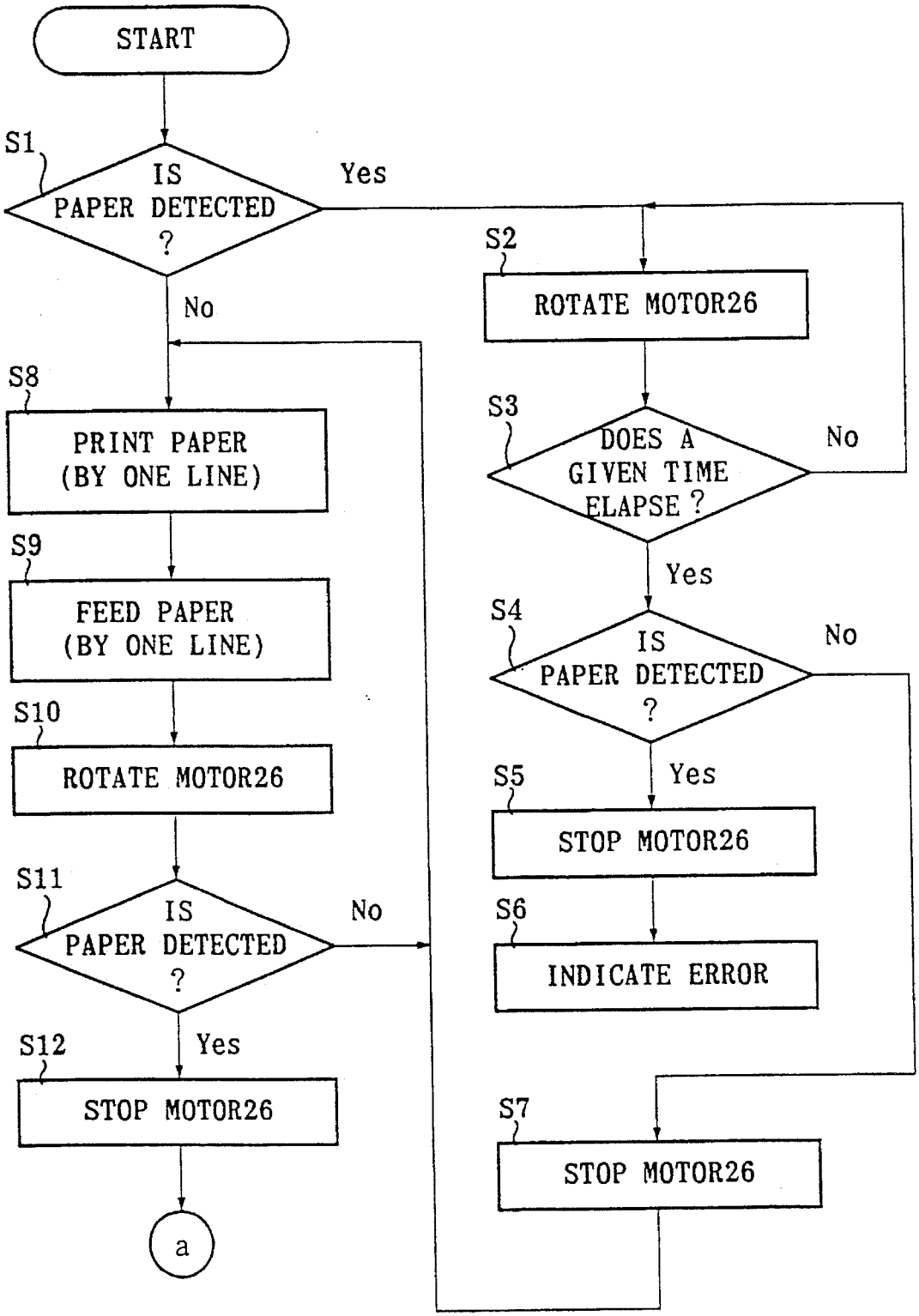
FIG. 8 is a flow chart showing a control program of printing and paper discharging operations.
Figure 9:
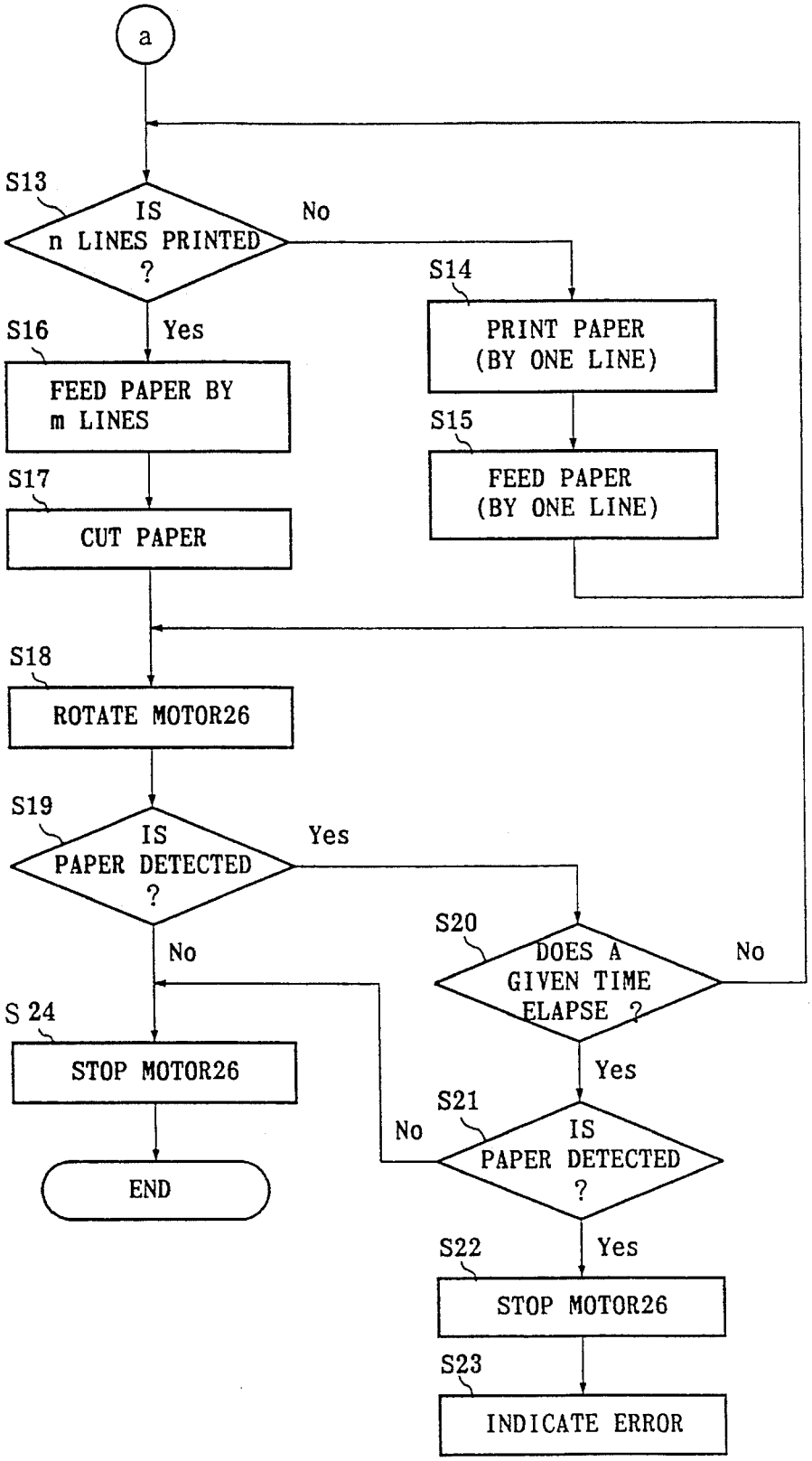
FIG. 9 is another flow chart showing a control program of printing and paper discharging operations.

FIGS. 8 and 9 show a program showing the paper feeding operation, the paper printing operation, the paper cutting operation and the paper discharging operation, in which denoted at "a" represents connecting symbols.

First, the control unit 110 is initialized when it receives power supply or it is reset by pressing a reset switch, then the paper feeding operation and the paper printing operation are performed at the same time.

In step S1, the paper detection sensor 76 detects the paper 20. If the paper 20 is detected, the program goes to step S2 where the motor 26 is rotated.

In step S3, the control unit 110 measures a driving time of the motor 26 counting from the start of the driving and judges as to whether a given time elapses or not. If a given time does not elapse, the program returns to step S2. As a result, the motor 26 keeps to drive for a given time and feeds the paper 20 for a given time.

In step S4, the paper detection sensor 76 detects again the paper 20. If the paper 20 is detected, the program goes to step S5 where the motor 26 is stopped and it goes to step S6.

In step S6, it is apparent that error occurs so that the indicator 132 is lighted to thereby indicate the error. By the indication of the error, an anomaly such as an occurrence of paper jam can be informed to a recipient.

If the paper 20 is not detected in step S4, the program goes to step S7 where the rotation of the motor 26 is stopped and it goes to step S8 where the paper printing operation is performed. In step S8, the paper is printed by one line and in step S9, the paper is fed by one line. This paper feeding operation is a line feed operation corresponding to a line printing. In step S10, the motor 26 is rotated so that the paper discharging operation starts.

In step S11, the paper detection sensor 76 detects again the paper 20 and if the paper 20 is not detected, the program returns to step S8. If the paper 20 is detected, the program goes to step S12 where the rotation of the motor 26 is stopped. In step S13, the control unit 110 judges as to whether n lines printing has been performed or not. If n lines printing is not performed, the program goes to step S14 where one line printing is performed. In step S15, a line feed by one line is performed and the program returns to step S13. In step S13, when the n lines printing is completed, i.e., upon completion of printing, the program goes to step S16 where the line feed of the paper 20 by m lines is performed for preparing the paper cutting operation and this paper feeding operation can be performed by the paper feed mechanism 8.

In step S17, the paper 20 is cut off and the program goes to step S18. In step S18, the motor 26 is rotated to start the paper discharging operation. In step S19, the paper detection sensor 76 detects the paper 20. If the paper 20 is detected, the program goes to step S20. In step S20, the control unit 110 judges as to whether a given time elapses starting from the detection of the paper 20. If a given time does not elapse, the program returns to step S18 where the operations in steps S18 and S19 are executed. If the control unit 110 judges that a given time has elapsed, the program goes to step S21 where the paper detection sensor 76 detects the paper 20. If the paper 20 is detected in step S21, the program goes to step S22 where the rotation of the motor 26 is stopped and the program goes to step S23 where the indicator 132 indicates error.

If the paper 20 is not detected, namely, the sensor 76 detects the discharge of the paper 20, the program goes to step S24 where the rotation of the motor 26 is stopped. When the rotation of the motor 26 is stopped, the paper discharging operation is completed and the control unit 110 enters into a standby state.

Figure 10:
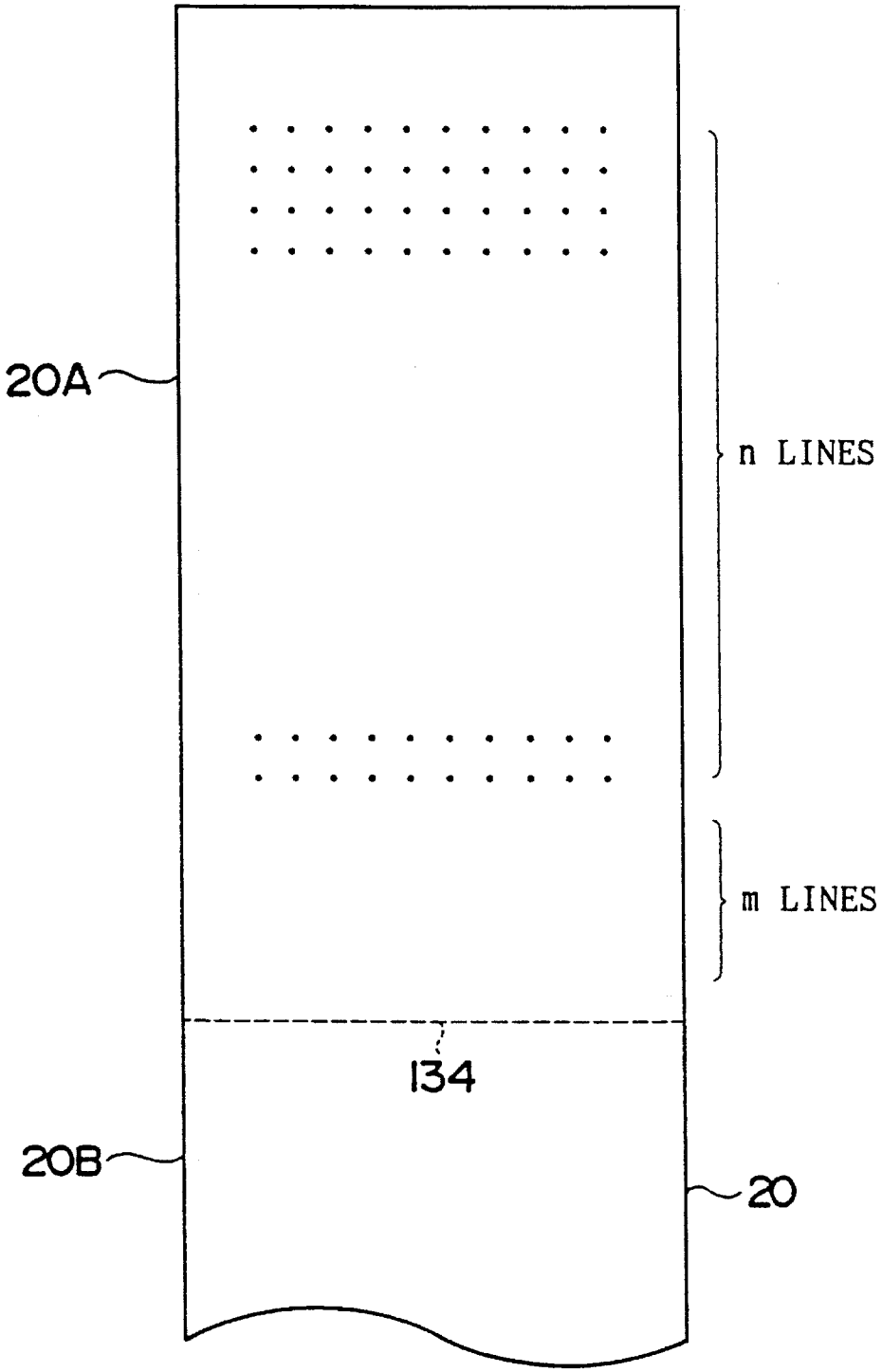
FIG. 10 is a plan view of the paper.

FIG. 10 shows the paper 20 having the printing by n lines and the line feeding by m lines respectively in steps S8 to S13 and in step S4 wherein a broken line represents a cutting position 134. A cut portion 20A of the paper 20 which was cut off at the cutting position 134 is continuously discharged from the paper discharge port 62 and a remaining portion 20B is placed at the paper feed passage 32 of the cutting apparatus 4.

The paper printing operation and the paper feeding operation will be described hereinafter with reference to FIGS. 11 to 13.

Figure 11:
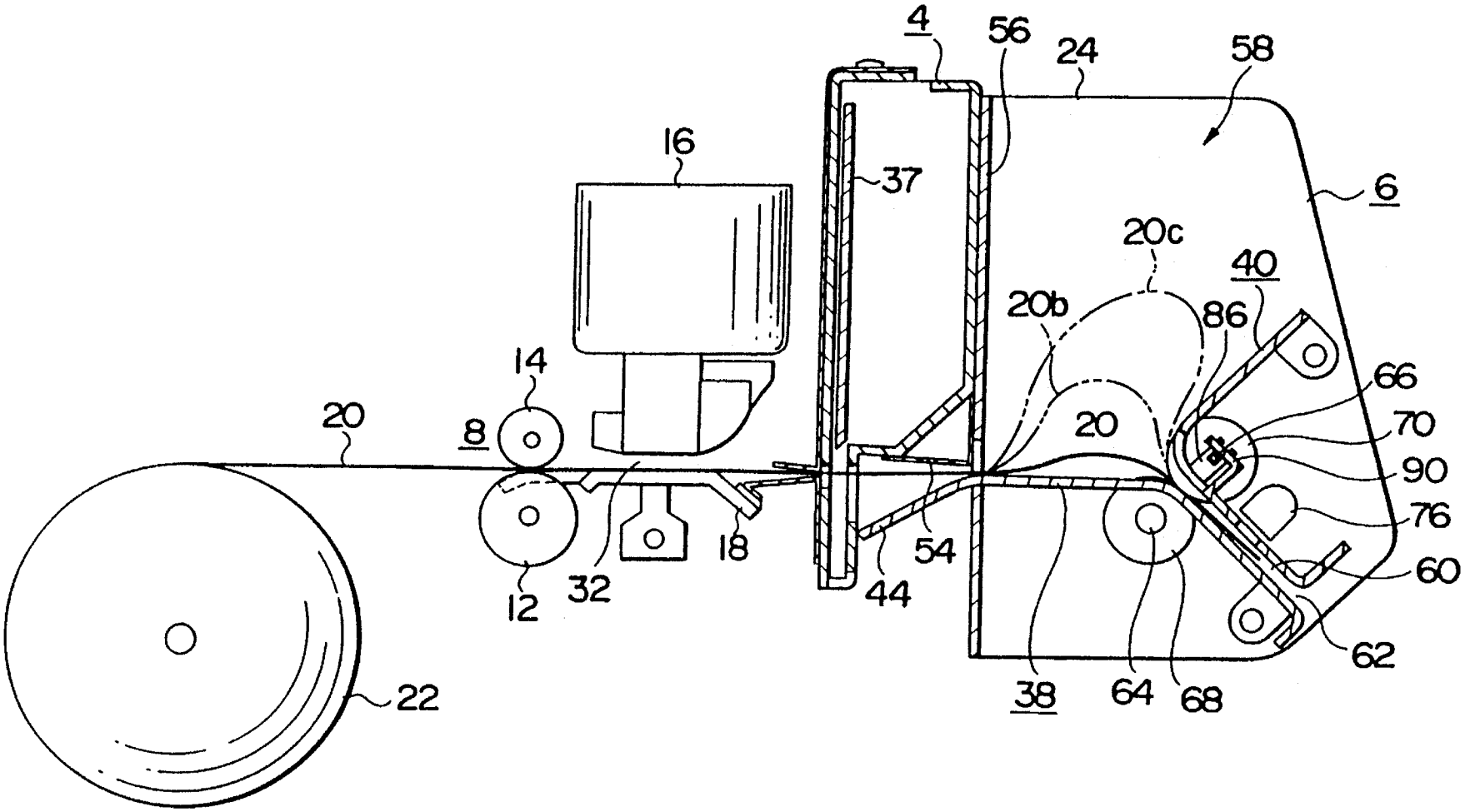
FIG. 11 is a cross-sectional view showing an operation of the paper discharge apparatus during printing.

FIG. 11 shows the printing operation after the paper is detected. In this case, when the paper 20 is clamped and fed by the discharge rollers 68 and 70 which are rotated by the motor 26, the leading end of the paper 20 reaches under the paper detection sensor 76 where it is detected by the paper detection sensor 76. At this time, the motor 26 is stopped so that the paper 20 is clamped and held by the discharge rollers 68 and 70. That is, the discharge rollers 68 and 70 are in standby condition. At this time, the printing operation is continuously performed and the paper 20 is fed by the paper feed mechanism 8. The cutting apparatus 4 is also in the standby condition at this time. Accordingly, the paper 20 is fed on the paper feed passage 32 in synchronization with printing operation and fed into the paper storage means 58. When the paper 20 is fed into the paper storage means 58 while the leading end thereof is held by the discharge rollers 68 and 70, it makes a loop inside the paper storage means 58, whereby it bulges as represented by loops 20*a*, 20*b* and 20*c* in response to the paper feeding as shown in FIG. 11.

Figure 12:
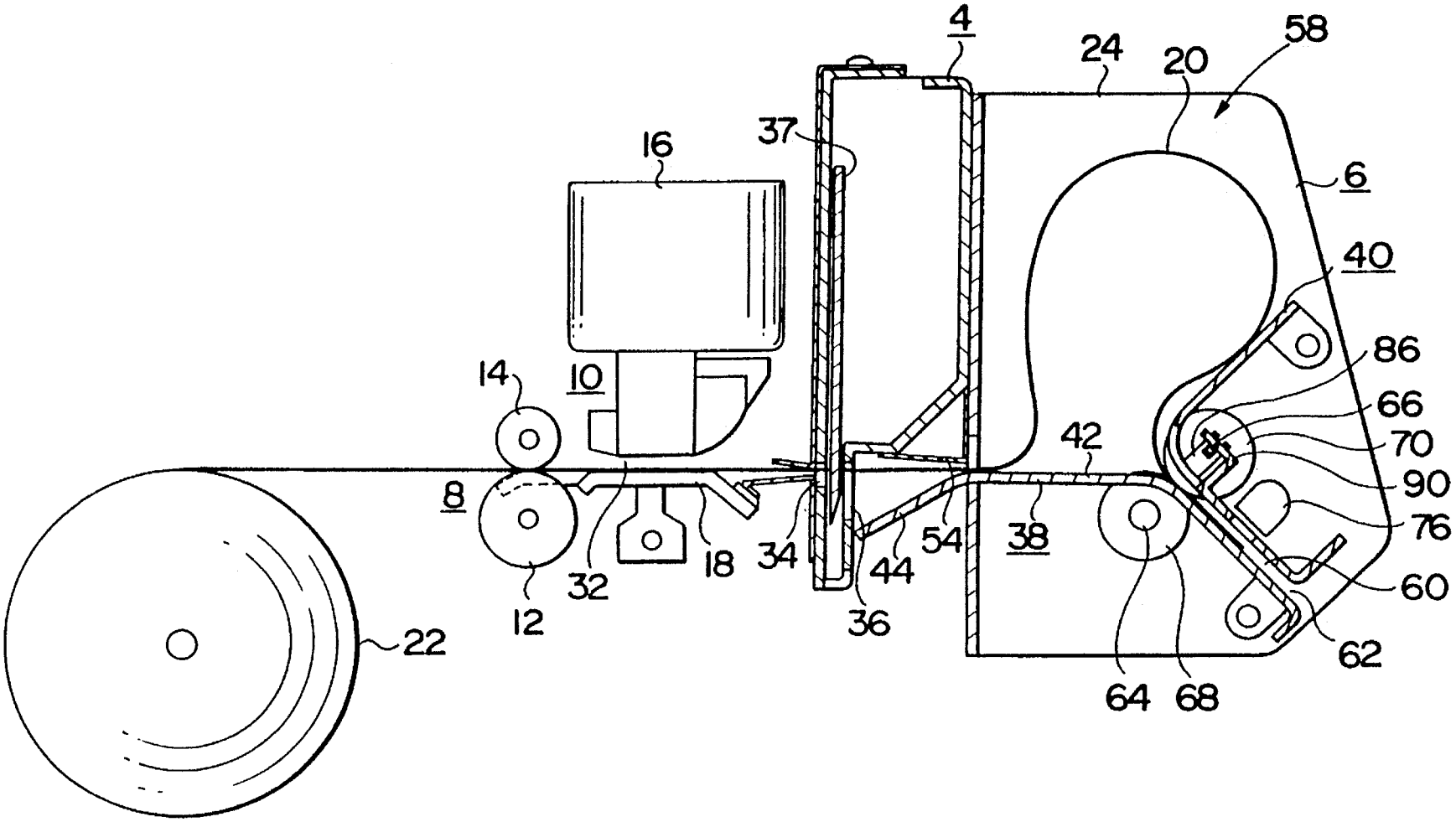
FIG. 12 is a cross-sectional view of the paper discharge apparatus showing a state where the paper is stored during printing.

FIG. 12 shows the paper cutting operation upon completion of the paper printing operation. When the printing operation is completed and successively the paper feeding operation by m lines is completed, the cutting apparatus 4 operates. The cutter blade 37 moves downward in FIG. 12, thereby cutting off the paper 20. Thereafter, the cutter blade 37 retracts or moves upward after it cut off the paper 20.

Figure 13:
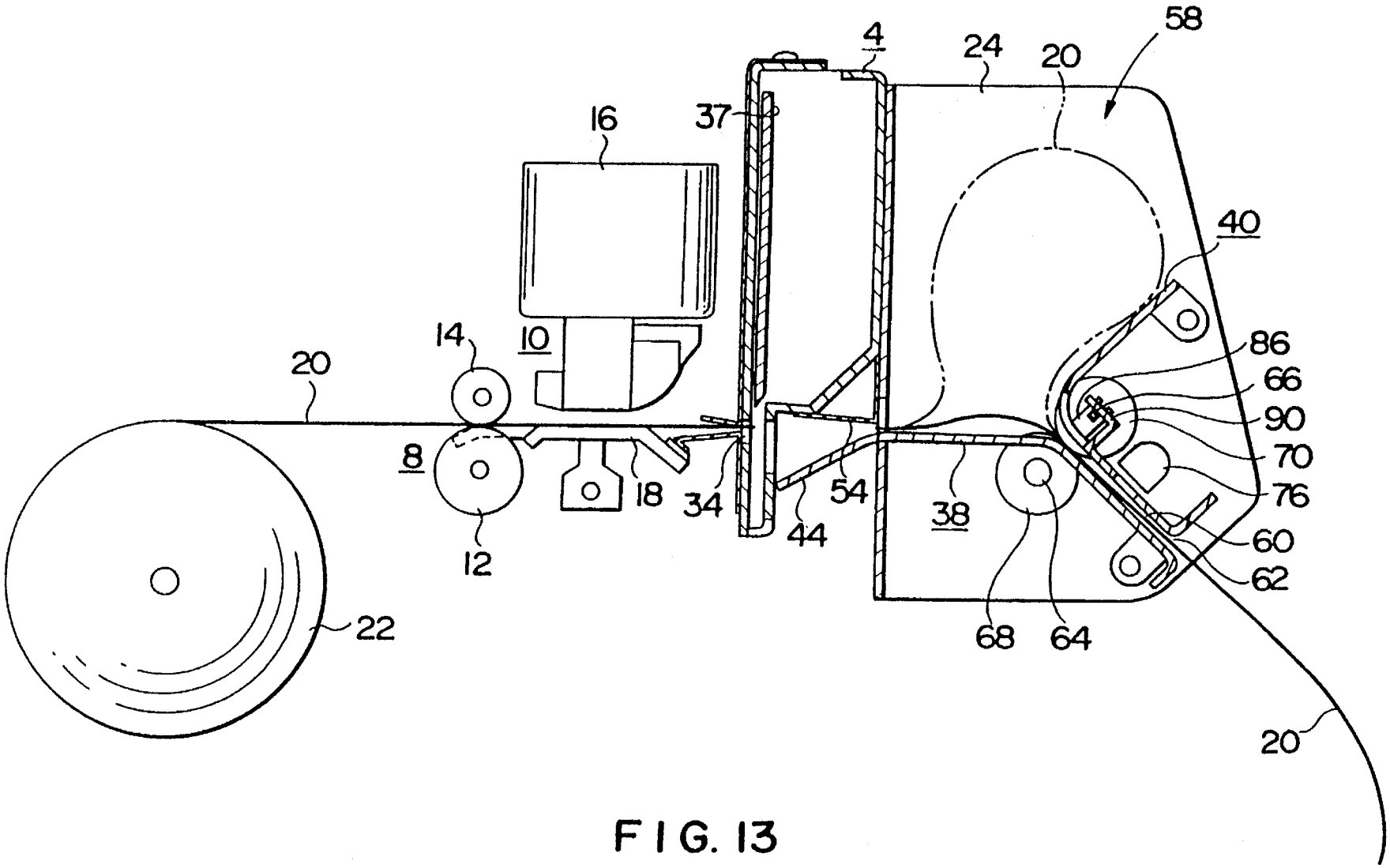
FIG. 13 is a cross-sectional view of the paper discharge apparatus showing a state where the paper is discharged upon completion of printing.

FIG. 13 shows the discharge of the paper after it was cut off. After the paper 20 was cut off, the motor 26 is driven so that the paper 20 is guided along the paper discharge passage 60 by the rotation of the discharge rollers 68 and 70 while directed to the paper discharge port 62, then it is successively discharged. When a trailing portion of the paper 20 is moved away from an area where the paper 20 is to be detected by the paper detection sensor 76, a detecting output representing the completion of the discharge of the paper is generated by the paper detection sensor 76, which is supplied to the control unit 110. As a result, the motor 26 is stopped and the paper discharging operation is completed. The cut paper 20 is issued as a receipt or tickets as to be received by the recipient.

In the paper discharge apparatus 6, the discharge rollers 68 and 70 have relatively large diameters and they are arranged in the manner that a line connecting the central axes of the discharge rollers 68 and 70 is inclined relative to a vertical line passing the center of the roller 68 by an angle of θ1. As a result, an opening angle formed by tangential lines L1 and L2 of the discharge rollers 68 and 70 becomes θ2. That is, the opening angle θ2 becomes 90° provided that the discharge rollers 68 and 70 have the same diameters and the inclination angle θ1 is 45°.

Figure 14A:
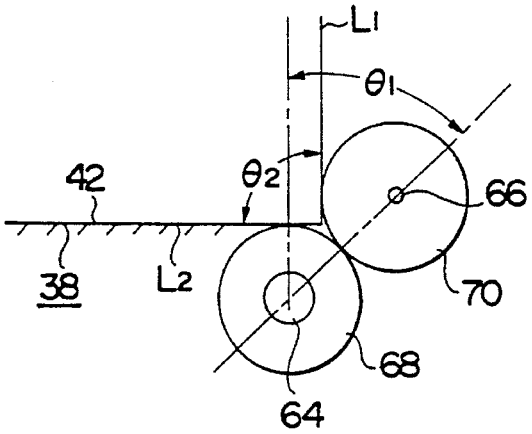
FIG. 14A is a view showing an arrangement of the discharge rollers.
Figure 14B:
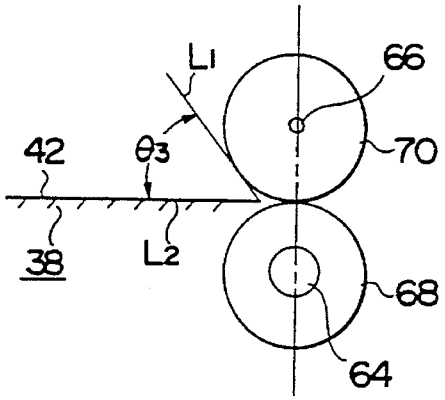
FIG. 14B is a view showing another arrangement of the discharge rollers.
Figure 15:
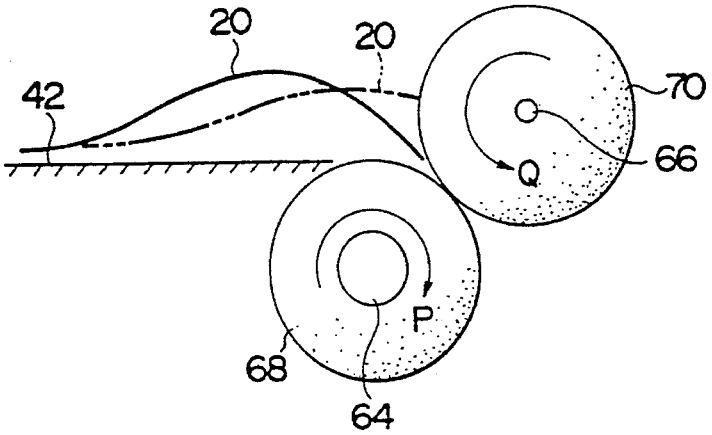
FIG. 15 is a view showing a state where the paper inroads between the discharge rollers.

FIG. 14 shows a case where the central axes of the discharge rollers 68 and 70 are located at the same position horizontally. In this case, an opening angle θ3 defined by the tangential lines L1 and L2 becomes 45°. As a result, the opening angles defined by the discharge rollers 68 and 70 are widened (θ2>θ3) by displacing the position of the axes of the discharge rollers 68 and 70, namely, by positioning the discharge rollers 68 a little upstream than the discharge rollers 70.

With the arrangement of the discharge rollers 68 and 70 as mentioned above, when the bent paper 20, which was caused by the curling property of the roll paper, is fed toward the discharge rollers 68 and 70 as shown by two-dot chain line, the leading end thereof can be effectively guided between the discharge rollers 68 and 70. Particularly, since the discharge rollers 68 rotate in the direction as denoted at an arrow P, i.e. clockwise while the discharge rollers 70 rotate in the direction as denoted at an arrow Q, i.e. counterclockwise, the paper 20 is guided by the discharge rollers 70 toward the discharge rollers 68 when the paper reaches the discharge rollers 70 at its leading end. The paper 20 is surely guided between the discharge rollers 68 and 70 due to the rotation of the discharge rollers 68 and 70 and the provision of the opening angle θ2 defined therebetween and it is surely discharged toward the paper discharge passage 60 without generating the paper jam.

Figure 16:
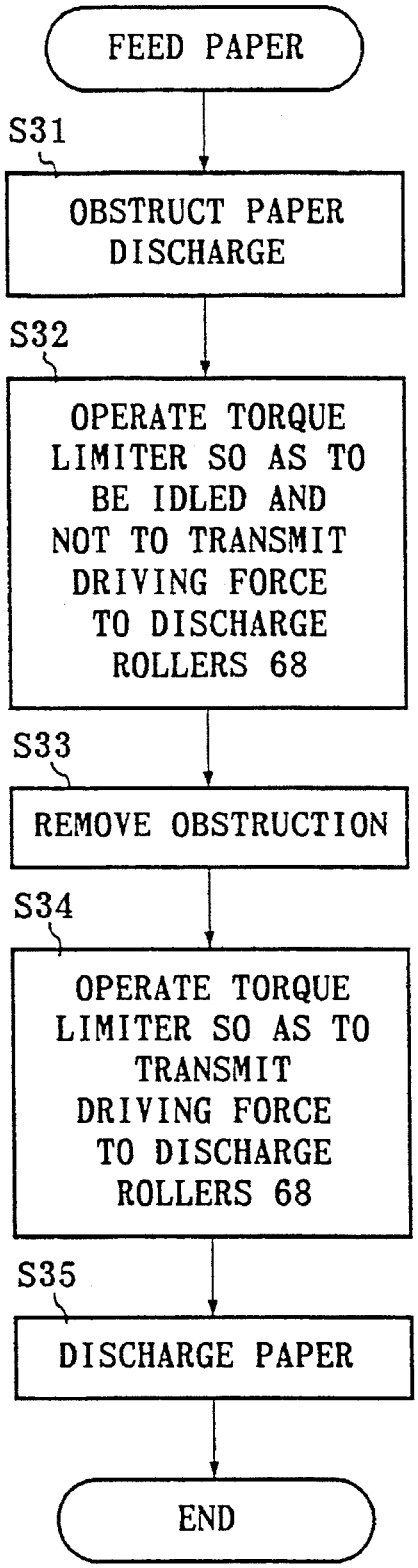
FIG. 16 is a flow chart showing an operation of the paper discharge apparatus when the paper discharge is obstructed.

FIG. 16 shows an operation of the paper discharge apparatus in a case where the paper 20 is prevented from being discharged, namely in such a case that the paper discharge port 62 is blocked.

In Step S31, the paper discharge port 62 is blocked so that the paper discharge operation is prevented. Stress applied to the paper 20 acts upon the torque limiter 30 as shown in step S32 so that the torque limiter 30 idles, thereby stop the rotation of the discharge rollers 68. As a result, the paper discharge is stopped. In Step S33, when the blocked condition is removed, a release of stress acts upon the torque limiter 30. As a result, the torque of the motor 26 is transmitted to the driving shaft 64 by way of the torque limiter 30 as shown in step S34 so that the paper 20 is discharged normally as shown in step S35.

With the provision of the torque limiter 30, the turning force of the motor 26 can be transmitted to the discharge rollers 68 without influencing printing accuracy. Furthermore, if the feeding speed of the paper 20 from the printer 2 is not the same as the discharging speed of the paper, force involved in the discharge of the paper can be absorbed by the torque limiter 30, thereby preventing a paper jam beforehand.

Figure 17:
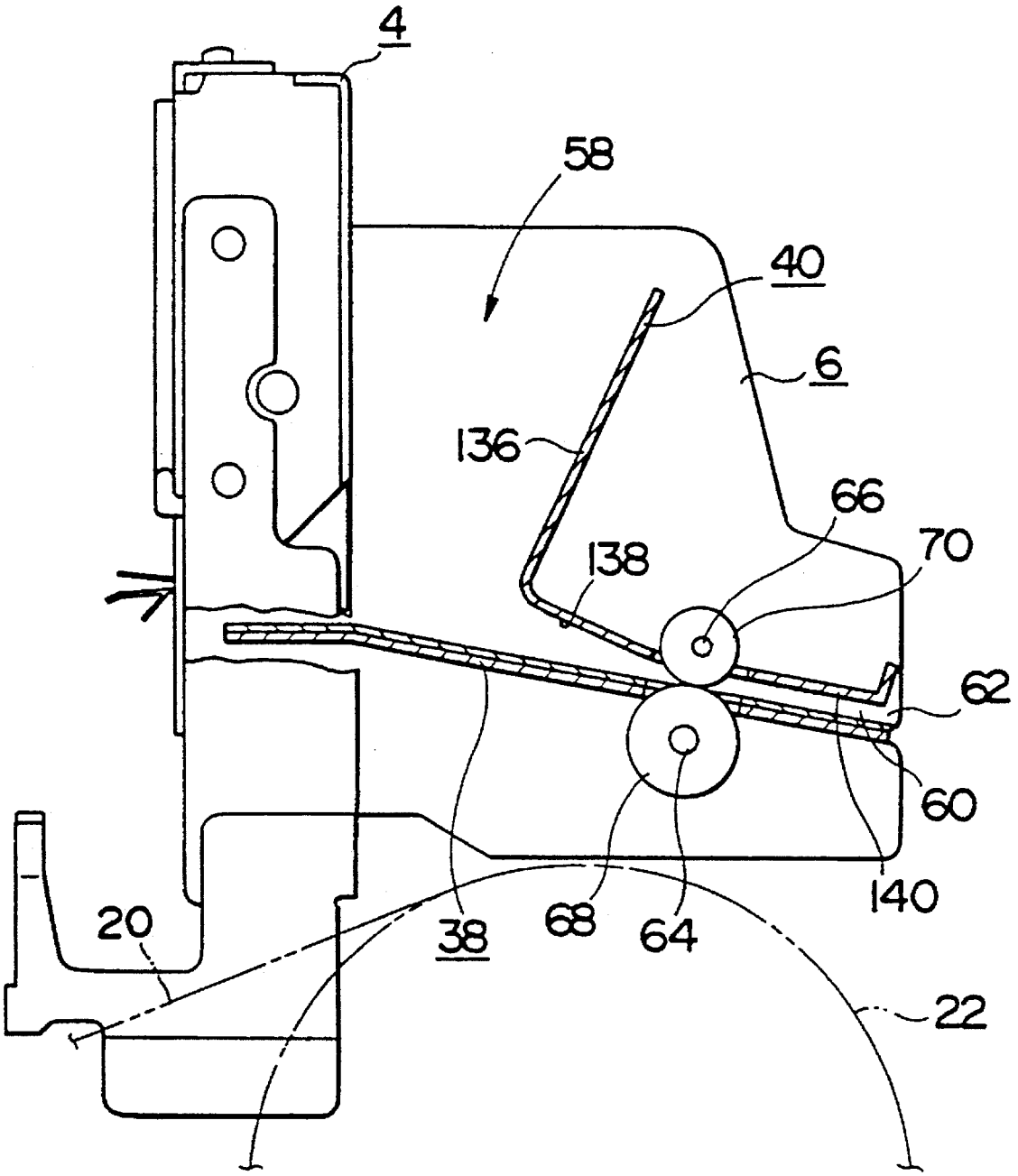
FIG. 17 is a cross-sectional view of a paper discharge apparatus according to a second embodiment of the present invention.

Second Embodiment (FIG. 17):

A paper discharge apparatus according to a second embodiment will be described with reference to FIG. 17.

In the paper discharge apparatus according to the second embodiment, the guide plate 38 is substantially fiat and has a slightly inclined surface at the paper discharge side. Another guide plate 40 is L-shaped and comprises inclined portions 136, 138 and 140. The inclined portion 136 serves as a wall surface of the paper storage means 58. The inclined portion 138 and the guide plate 38 form a paper introduction portion for introducing the paper 20 and the inclined portion 140 forms the paper discharge passage 60. The discharge rollers 68 and 70 are disposed at an inlet portion of the paper discharge passage 60. The discharge rollers 70 are smaller than the discharge rollers 68. The driving force of the motor 26 can be transmitted to the driving shaft 64 of the discharge rollers 68 by way of the torque limiter 30 like the first embodiment. With such an arrangement of the second embodiment, the paper 20 can be smoothly discharged like the first embodiment.

Figure 18:
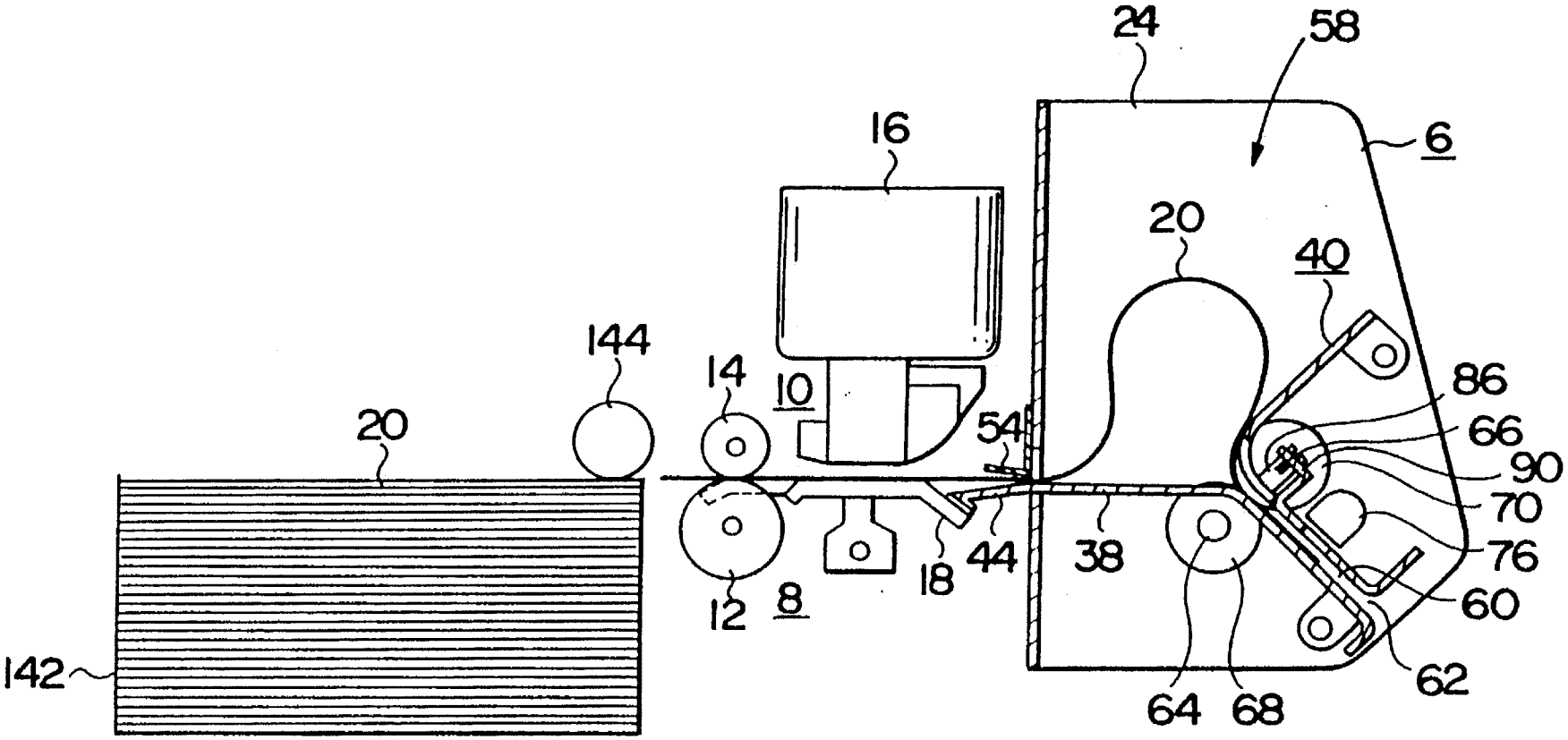
FIG. 18 is a cross-sectional view of a paper discharge apparatus according to a third embodiment of the present invention.

Third Embodiment (FIG. 18):

A paper discharge apparatus according to a third embodiment will be described with reference to FIG. 18.

In the paper discharge apparatus 6 according to the third embodiment, sheets cuts are employed as the paper 20. The sheets cuts of the paper 20 are accommodated in a stacker 142 and they are fed one by one by a feeder 144 to the feed rollers 12 and 14. The paper may be continuous paper perforated stock.

Figure 19:
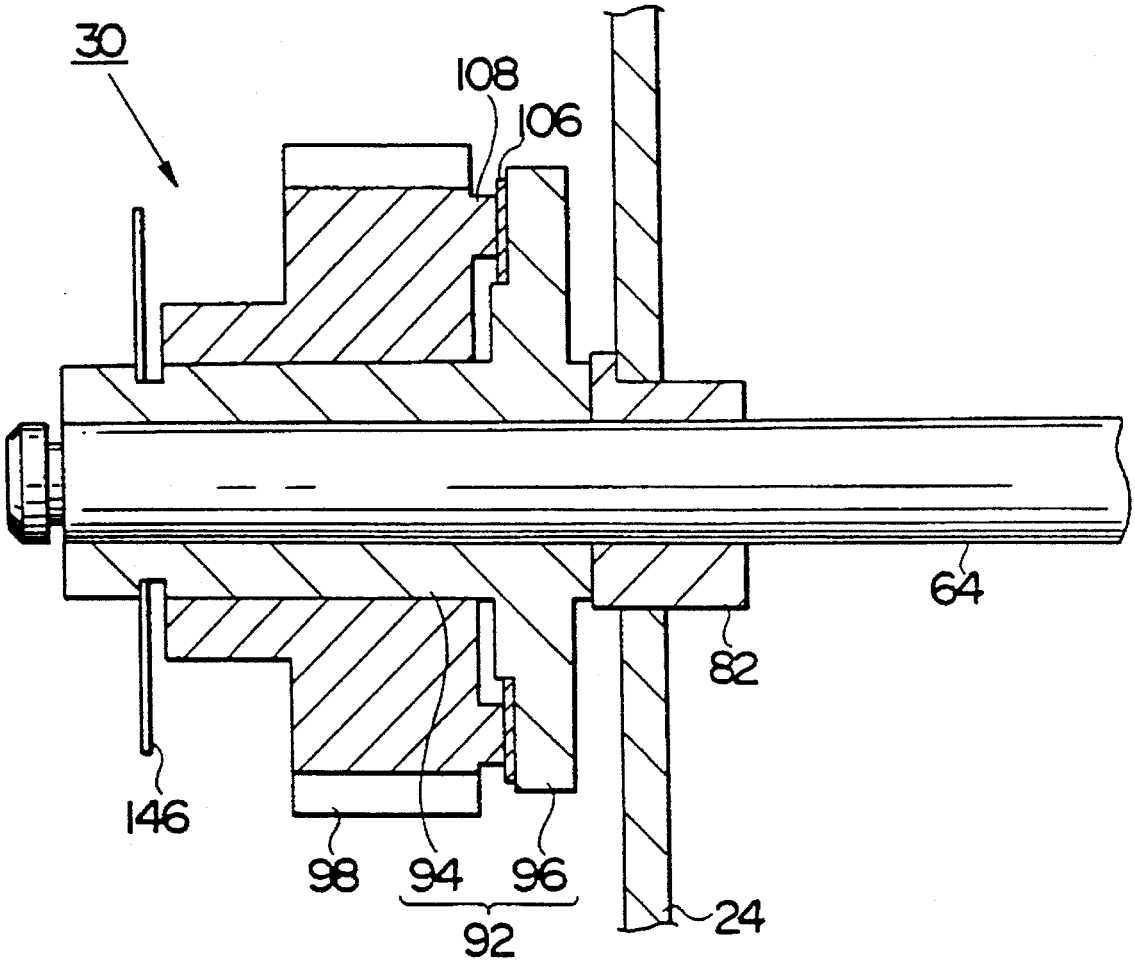
FIG. 19 is a cross-sectional view of another torque limiter of the paper discharge apparatus.

Fourth Embodiment (FIG. 19):

A paper discharge apparatus according to a fourth embodiment will be described with reference to FIG. 19.

The paper discharge apparatus 6 has a modified torque limiter 30. Although in the torque limiter 30 of the first embodiment, the clutch portion 92 and the gear 98 are brought into contact with each other under pressure by the coil spring 104, the gear 98 and the clutch portion 92 of the third embodiment are formed of a magnet respectively and they are attracted to each other by magnetic force, thereby generating appropriate pressure for bringing the gear 98 into contact with the clutch portion 92 under appropriate pressure. In this case, the gear 98 is rotatably restrained on the small diameter portion 94 of the clutch portion 92 by a stop plate 146 fixed to the end portion of the clutch portion 92.

With such an arrangement of the torque limiter, it is possible to stand by the discharge of the paper without generating the paper jam even if the paper discharge is obstructed and to quickly discharge the paper 20 when such an obstruction is removed.

Other embodiments of the present invention are as follows.

1. If the rotational speed of the motor 26 is speeded up compared with the feeding speed of the paper at the paper feeding side, it is possible to reduce the stand-by time involved in discharging the paper.

Figure 20:
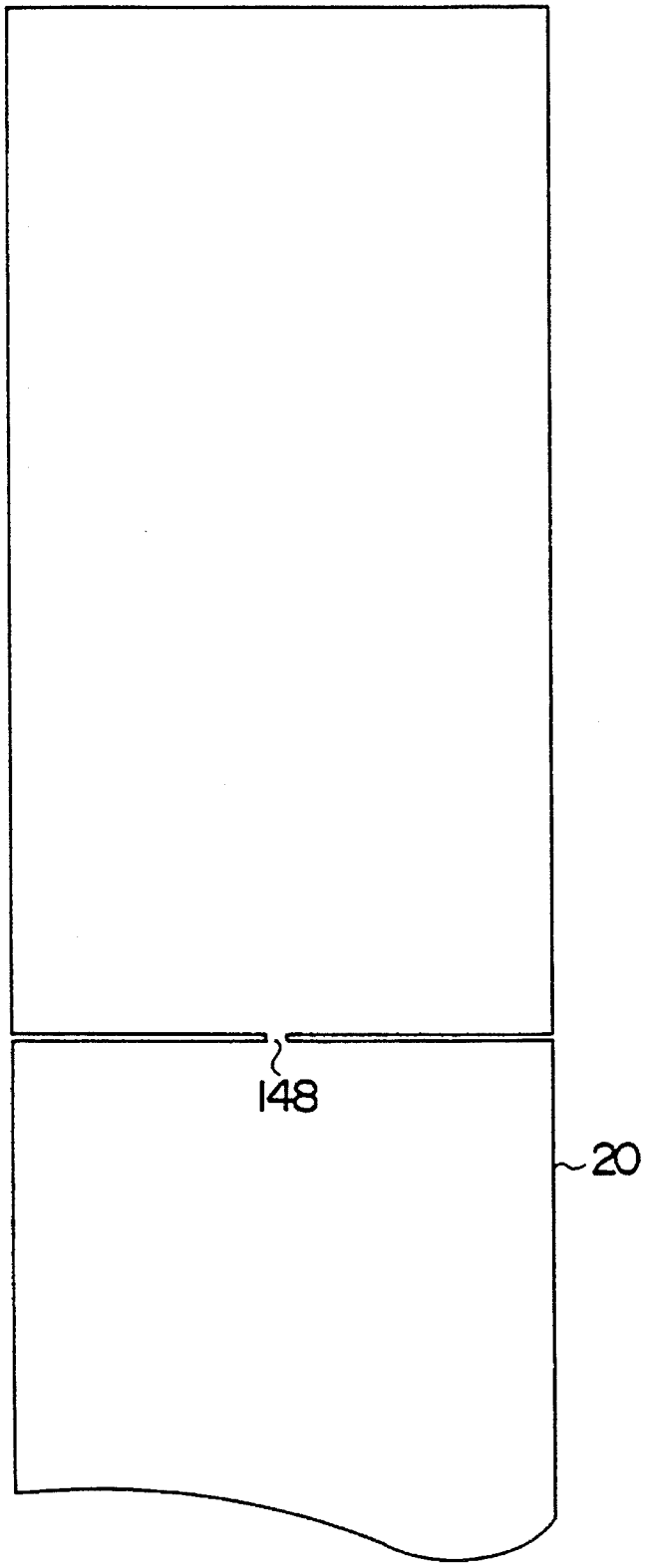
FIG. 20 is a plan view of another paper to be discharged.
Figure 21A:
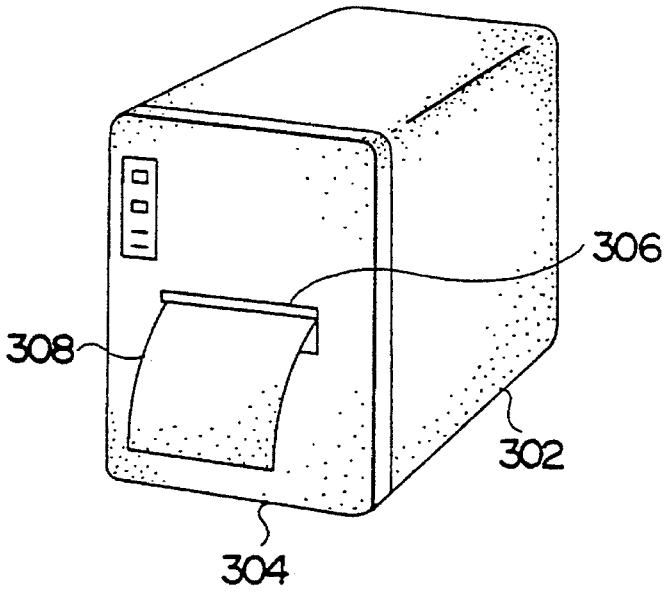
PRIOR ART FIG. 21A
FIG. 21A is a perspective view of a conventional printer.
Figure 21B:
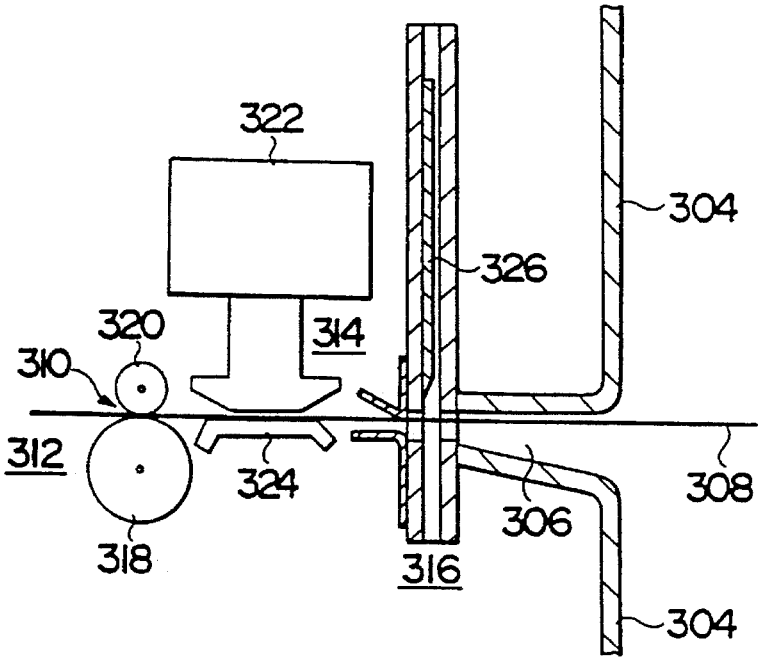
PRIOR ART FIG. 21B
FIG. 21B is a cross-sectional of an internal structure of the printer in FIG. 21A.
Figure 22:
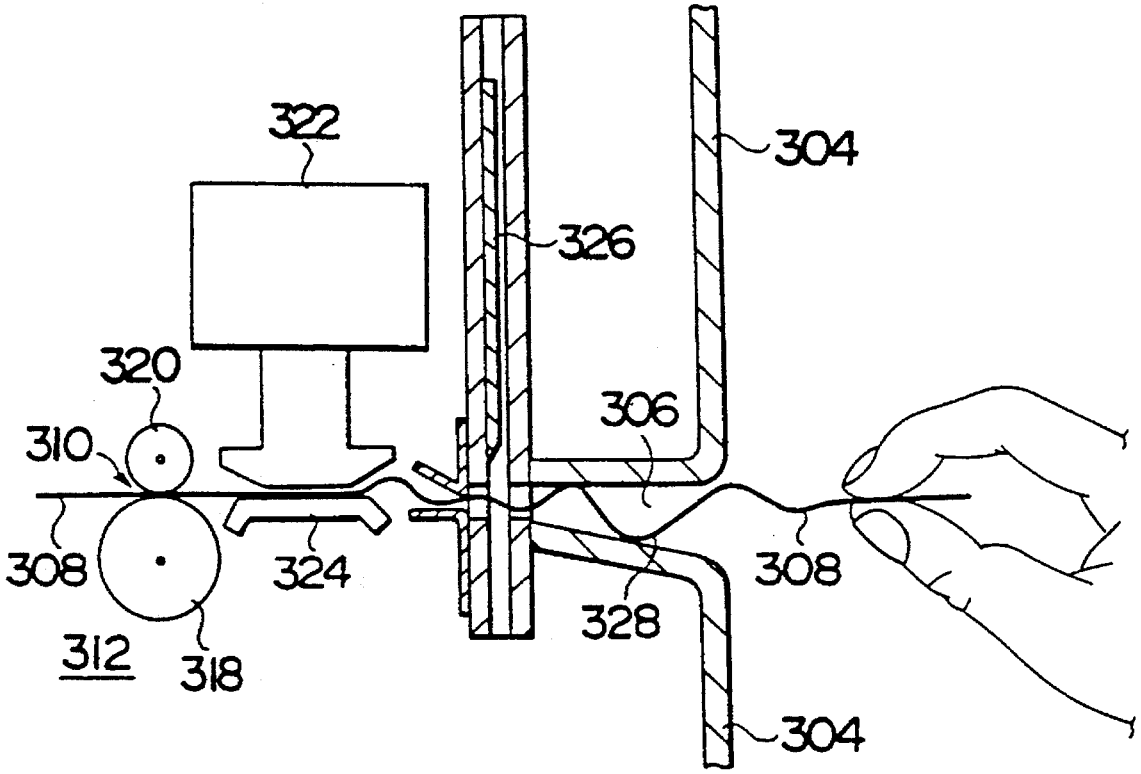
PRIOR ART FIG. 22
FIG. 22 is a cross-sectional view showing a state where a recipient stands by while picking up the paper to be discharged.
Figure 23A:
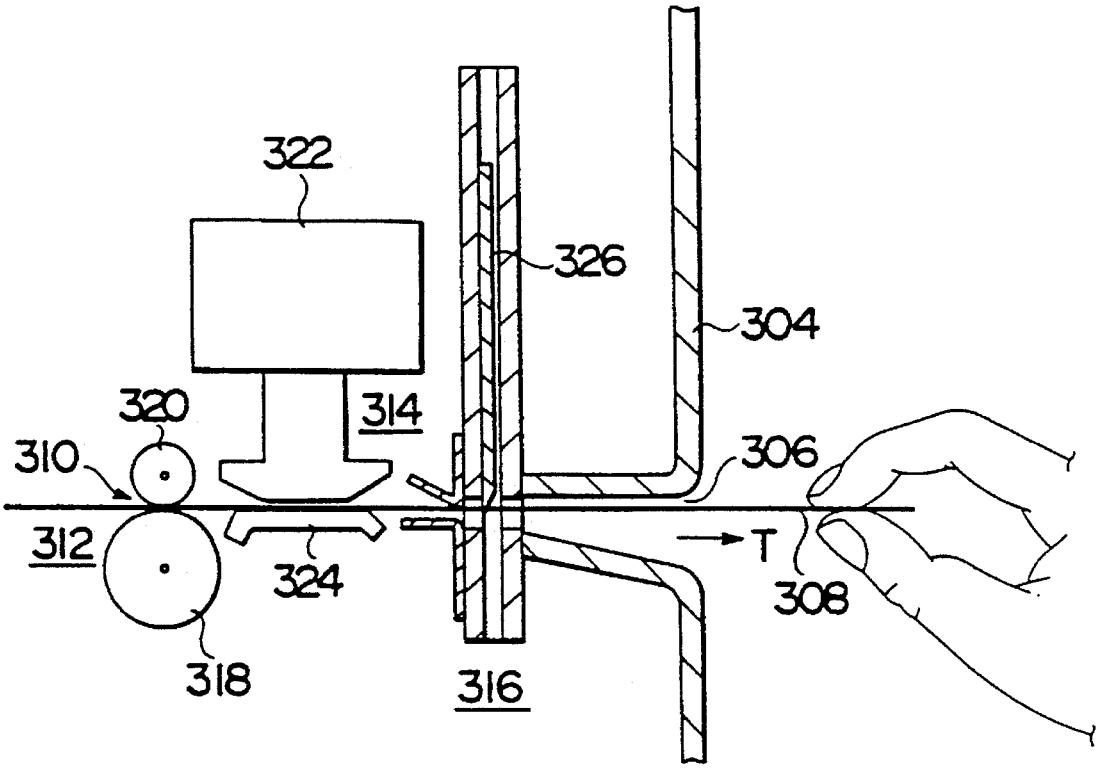
PRIOR ART FIG. 23A
FIG. 23A is a cross-sectional view showing a state where tension is applied to the paper to be discharged.
Figure 23B:
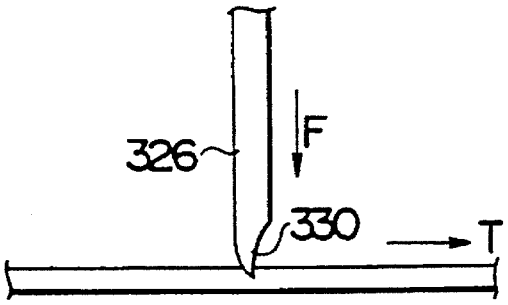
PRIOR ART FIG. 23B
FIG. 23B is a cross-sectional view showing a state where an edge of a cutter blade is deformed due to the tension applied to the paper to be discharged.

2. The paper 20 may be cut off with a small coupling portion 148 left at the middle portion thereof as shown in FIG. 20. With the provision of the small coupling portion 148, the paper 20 is held at the side of the printer 2 so that the paper 20 can be more stably fed and discharged. Furthermore, the paper 20 can be pulled out at the side of the paper discharge apparatus 6 when discharged and the recipient can apply an appropriate tension to the paper 20 so that the paper 20 can be easily cut off at the coupling portion 148.

3. In controlling the cutting apparatus 4, if the cutter blade 37 is held down until the paper 20 is completely discharged, it is possible to prevent the paper 20 from being returned to a paper supply source. If the paper 20 is returned to the paper supply source, next paper is prevented from being discharged. However, the paper can be smoothly discharged according to this modification.

As mentioned above, according to the present invention, there are the following effects.

Even if the leading end of the paper is curled, since the clamping allowable angle defined between the discharge rollers 68 and 70 is set to be sufficiently large, the paper can be surely clamped by the discharge rollers 68 and 70 so that the paper can be safely fed. Particularly, even if the paper is curled when the roll paper is employed or it is deformed when pressed by the feed rollers or the paper is softened by moisture, such a paper can be surely and smoothly fed, whereby a stable paper feeding operation can be performed and the paper jam can be surely prevented.

If the paper discharge is obstructed, the paper discharging operation is stopped while the torque limiter is idled. When the obstruction is removed, the paper can be discharged, whereby the paper can be discharged reliably and the paper jam can be prevented.

The printed paper to be discharged can be kept as a loop in the paper storage means and the paper can be discharged independently of the printing and paper cutting operations so that the obstruction of the discharge of the paper can be prevented.

What is claimed is:

1. A paper discharge apparatus for a printer, comprising:

feed rollers responding to a driving force for feeding paper from a paper roll;

a print mechanism disposed along a paper feed path for printing said paper;

cutting means disposed along said paper feed path for cutting said paper from said paper roll upon completion of printing;

discharge rollers for clamping a leading end of said fed paper and discharging said paper toward a paper discharge port;

said discharge rollers including first driving rollers driven by a motor, and second driven rollers offset from said first driving rollers relative to the paper feed path, the axes of corresponding driving and driven rollers connected along a line forming an obtuse angle with the direction of the feed path;

a torque limiter disposed between a driving shaft of said first driving rollers of said discharge rollers and a rotary shaft of said motor as a torque transmission means for transmitting torque to said first driving rollers through said driving shaft and preventing said torque from being transmitted to said driving shaft in response to load applied to said paper when said discharge of said paper is obstructed;

a paper storage area disposed along said paper feed path between said discharge rollers and cutting means for storing a bulging portion of said paper which bulges when said paper is fed by said feed rollers and the leading end of said paper is restrained by said discharge rollers;

a paper detection sensor disposed near the paper discharge port for detecting the leading end of said paper; and control means for controlling said teed rollers, print mechanism, cutting means and discharge rollers, wherein— said control means controls the driving of said feed rollers when the leading end of said paper is restrained by said discharge rollers, and further causes said print mechanism to print on said paper fed by said feed rollers; and said control means further causing the driving of said motor to permit said discharge rollers to discharge said paper after said paper is cut, and stopping motor operation when said paper detection sensor detects completion of discharge of said paper upon the passing of a trailing end of said paper through the discharge port.

2. A paper discharge apparatus according to claim 1, wherein said paper storage area is defined by:

a first guide plate for supporting said paper to be discharged;

a second guide plate disposed over said guide plate;

side plates for supporting said driving shaft; and an upright wall provided between said side plates.

3. A paper discharge apparatus according to claim 1, wherein said torque limiter comprises:

a clutch portion attached to said driving shaft;

a gear which is rotatably attached to said clutch portion, and to which said motor torque is transmitted; and a spring for urging a contact portion on said gear into contact with said clutch portion to transmit said motor torque to said clutch portion.

4. A paper discharge apparatus according to claim 1, wherein said torque limiter comprises:

a clutch portion which is formed of a magnet and attached to said driving shaft;

a gear which is formed of a magnet and rotatably attached to said clutch portion, and to which said torque is transmitted from said motor, wherein said gear and said clutch portion are connected to each other by magnetic attraction.

* * * * *